US010221844B2

(12) United States Patent
Lofstrom et al.

(10) Patent No.: US 10,221,844 B2
(45) Date of Patent: Mar. 5, 2019

(54) FLUID HANDLING SYSTEM FOR A PARTICLE PROCESSING APPARATUS

(71) Applicant: CYTONOME/ST, LLC, Boston, MA (US)

(72) Inventors: Christopher D. Lofstrom, Fort Collins, CO (US); Coby S. Hughey, Fort Collins, CO (US); Blair D. Morad, Ipswich, MA (US)

(73) Assignee: CYTONOME/ST, LLC, Bedford, MA (US)

( * ) Notice: Subject to any disclaimer, the term of this patent is extended or adjusted under 35 U.S.C. 154(b) by 601 days.

(21) Appl. No.: 14/713,801

(22) Filed: May 15, 2015

(65) Prior Publication Data

US 2015/0330385 A1 Nov. 19, 2015

Related U.S. Application Data

(60) Provisional application No. 61/994,712, filed on May 16, 2014.

(51) Int. Cl.
*F04B 43/12* (2006.01)
*F04B 49/06* (2006.01)
(Continued)

(52) U.S. Cl.
CPC ..... *F04B 43/12* (2013.01); *F04B 11/00* (2013.01); *F04B 49/06* (2013.01); *F04B 49/065* (2013.01); *F04B 49/08* (2013.01)

(58) Field of Classification Search
CPC F04B 11/00; F04B 43/12; F04B 49/06; F04B 49/065; F04B 49/08
See application file for complete search history.

(56) References Cited

U.S. PATENT DOCUMENTS 4,762,473 A * 8/1988 Tieben ..... E21B 43/127 417/399
4,854,836 A * 8/1989 Borsanyi ..... F04B 43/0072 264/573

(Continued)

OTHER PUBLICATIONS

Rosemount. Technical Data Sheet 00816-0100-3206 Rev. BA. Technical Data Sheet 00816-0100-3206 Rev. BA, Rosemount, 2000.*
U.S. Appl. No. 14/713,594, filed May 15, 2015, 10,025,322.

*Primary Examiner* — Patrick Hamo
*Assistant Examiner* — Joseph S. Herrmann
(74) *Attorney, Agent, or Firm* — McCarter & English, LLP; David R. Burns

(57) ABSTRACT

A fluid handling system for a particle processing instrument includes a pump, a pulse attenuator, a pressure transducer, and a pump controller. The pump may be configured to supply a pulsed flow of fluid having a first pulse characteristic to the pulse attenuator. The pulse attenuator may have a single, undivided, volume, fluid inlets, fluid outlets, and a pressure sensor port. The pulse attenuator may supply an outlet flow of fluid having a second pulse characteristic different from the first pulse characteristic. The pressure transducer may be in fluid communication with the pressure sensor port and in control communication with the pump controller. The pump controller may be in control communication with the pump to maintain a substantially constant nominal pressure within the pulse attenuator by controlling the pump motor.

20 Claims, 10 Drawing Sheets

(51) Int. Cl.
*F04B 49/08* (2006.01)
*F04B 11/00* (2006.01)

(56) References Cited

U.S. PATENT DOCUMENTS

| | | | | |
|---|---|---|---|---|
| 8,597,573 | B2 | 12/2013 | Gilligan | |
| 9,551,637 | B2 * | 1/2017 | Fox | G01N 1/286 |
| 9,592,483 | B2 * | 3/2017 | Fox | B01F 13/0059 |
| 10,025,322 | B2 | 7/2018 | Lofstrom et al. | |
| 2008/0216898 | A1 | 9/2008 | Grant et al. | |
| 2008/0249501 | A1 * | 10/2008 | Yamasaki | A61M 25/0028 604/506 |
| 2011/0300010 | A1 * | 12/2011 | Jarnagin | A61B 17/3207 417/477.2 |

* cited by examiner

FLUID HANDLING SYSTEM FOR A PARTICLE PROCESSING APPARATUS

RELATED APPLICATIONS

This application claims the benefit of U.S. Provisional Application Ser. No. 61/994,712, filed May 16, 2014, the contents of which are incorporated by reference herein in its entirety.

FIELD

The present disclosure generally relates to fluid flow instruments, e.g., particle processing apparatuses, and more particularly relates to methods and systems for controlling, operating and optimizing fluid handling associated with fluid flow instruments.

BACKGROUND

Flow cytometers are use in research and clinical applications to analyze the characteristics of particles or cells. Typically, in these systems, a particle stream is injected into the center of a laminar sheath flow stream. The combined stream is passed through an interrogation region, where cells of interest are identified and/or characterized. With the addition of a sorting functionality, a flow cytometer can further be used to isolate particle(s) of interest from a sample. In droplet sorters, the stream may subsequently be divided into droplets, with droplets containing the cells of interest be sorted into separate collection chambers.

In conventional droplet sorters, a suspension including a sheath fluid and a sample containing particles passes through a nozzle and is formed into a focused fluid stream for particle detection and analysis. The fluid stream is oscillated with an oscillator to generate droplets. In order to sort particles within the fluid stream, the fluid stream may be charged just before a droplet containing a particle of interest separates from the fluid stream at a breakoff point. The droplet retains the charge and as it passes through an electromagnetic field downstream of the breakoff point it is directed to the desired location. A precise coordination between the particle detection and the droplet charging at the breakoff point is required. This drop delay parameter is one of the most important determinations required for performing accurate sort actions.

The stability of the flow of the fluid stream is especially important for sorting applications, because perturbations in the fluid flowing through the instrument may adversely impact the stability of the droplet break off point and thus the accuracy of the drop delay parameter. Accordingly, a sheath flow delivery system should provide sufficient flow capacity with a substantially invariant flow rate and pressure. Further, sheath flow delivery systems should provide stable sheath flow in the presence of variations in the operating environment (e.g., temperature, etc.), variations in the equipment operation (e.g., run-in, voltages, etc.), and variations in the fluid flowing through the system (e.g., pressures, viscosity, etc.). Additionally, a sheath flow delivery system should provide a sheath flow free of bubbles and should maintain the sterility of the sheath flow.

U.S. Pat. No. 8,597,573 to Gilligan (issued Dec. 3, 2013), which discloses a continuously regulated precision pressure fluid delivery system, is hereby incorporated by reference in its entirety herein. Gilligan discloses a fluid flow characteristic regulator which provides a variable volume flow path in which a fluid flow can be continuously adjusted by a control fluid to regulate at least one fluid flow characteristic of the fluid flow within the variable volume flow path.

SUMMARY

The following presents a general summary of exemplary embodiments in order to provide a basic understanding of at least some aspects of the systems and methods disclosed herein. This summary is not an extensive overview of the present disclosure. Nor is it intended to identify key or critical elements or to delineate the scope of the present disclosure. The following summary merely presents some general concepts of the present disclosure as a prelude to the more detailed description provided below.

Certain aspects of this disclosure relate to an improved system and method for handling fluid supplied to a fluid flow instrument.

One aspect of this disclosure provides a fluid handling system for a particle processing instrument. The fluid handling system may include a pump, a pulse attenuator, a pressure transducer, and a pump controller. The pump may be configured to supply a pulsed flow of sheath fluid having a first pulse characteristic to the pulse attenuator. The pulse attenuator may consist of a single, undivided, volume, one or more sheath fluid inlets, one or more sheath fluid outlets, and a pressure sensor port. The pulse attenuator may be configured to be in fluid communication with the pump to receive the pulsed flow of sheath fluid via the one or more sheath fluid inlets. The pulse attenuator may further be configured to supply an outlet flow of sheath fluid via the one or more sheath fluid outlets. The outlet flow has a second pulse characteristic different from the first pulse characteristic. The pressure transducer may be in fluid communication with the pressure sensor port and in control communication with the pump controller. The pump controller may be in control communication with the pump and is configured to maintain a substantially constant nominal pressure within the pulse attenuator by controlling the pump.

Another aspect of this disclosure provides a method of regulating a fluid flow. The method may include closing a valve downstream of a pulse attenuator, flowing a fluid into the pulse attenuator until a predetermined nominal pressure is obtained within the pulse attenuator, and opening the valve downstream of the pulse attenuator to allow fluid to flow from the pulse attenuator. The method may further include generating a fluid flow having a pressure pulse profile, receiving the fluid flow having the pressure pulse profile into the pulse attenuator, sensing a pressure within the pulse attenuator, adjusting a flow rate of the fluid flow based on the sensed pressure within the pulse attenuator, and maintaining the pressure within the pulse attenuator to a substantially constant pressure.

BRIEF DESCRIPTION OF THE DRAWINGS

A more complete understanding of the present disclosure and certain advantages thereof may be acquired by referring to the following description in consideration with the accompanying drawings, in which like reference numbers indicate like features.

DETAILED DESCRIPTION

In the following description of various example embodiments, reference is made to the accompanying drawings, which form a part hereof, and in which are shown by way of illustration various example devices, systems, and environments in which aspects of exemplary embodiments disclosed herein may be practiced. It is to be understood that other specific arrangements of parts, example devices, systems, and environments may be utilized and structural and functional modifications may be made without departing from the scope of the present disclosure.

Certain embodiments described herein relate to the particle processing systems for the analysis and sorting of particles. A particle processing system may be configured, dimensioned and adapted for analyzing, sorting, and/or processing (e.g., purifying, measuring, isolating, detecting, monitoring and/or enriching) particles (e.g., cells, microscopic particles, etc.) or the like. For example, a particle processing system may include a flow cytometer, a droplet sorter, a microfluidic chip, a liquid chromatograph, a cell purification system, other flow-through analytical instruments or the like, although the present disclosure is not limited thereto.

The systems and methods described herein may be applied to fluid flow instruments, e.g., particle processing systems, requiring a substantially stable, controlled delivery of fluid. A fluid handling system for providing a consistent, stable, and controlled flow of fluid to the instrument is disclosed herein. The fluid handling system encompasses both devices and methods for the delivery of fluid to a fluid flow instrument.

Thus, according to aspects of this disclosure, a fluid handling system may be in fluid communication with a fluid flow instrument to provide intermittent or continuous delivery of a fluid to the instrument. The fluid may be a sheath fluid, a sample fluid, a reagent fluid, a flushing fluid, a cleaning fluid, etc.

For example, during operation of a typical flow cytometer, a sheath fluid stream and a sample fluid stream are provided to the instrument. The sample stream and the sheath fluid stream join within the flow cytometer to form an entrained stream. The fluid flow parameters of the sheath fluid (and of the sample fluid) entering the cytometer affect the performance of the cytometer.

In jet-in-air flow cytometers, the entrained stream passes through a nozzle to form droplets. Because certain operating characteristics (e.g., formation of droplets, droplet break-off point, or the like) of the flow cytometer may be influenced by the sheath fluid flow rate, the sample fluid flow rate, the sheath fluid pressure, the sample fluid pressure, or the like, it is desirable to control these fluid input parameters. The fluid handling systems described herein advantageously provide fluid flow(s) to the fluid flow instrument that have substantially smooth, stable flow parameters, thereby resulting in a more consistent operation of the fluid flow instrument.

Figure 1:
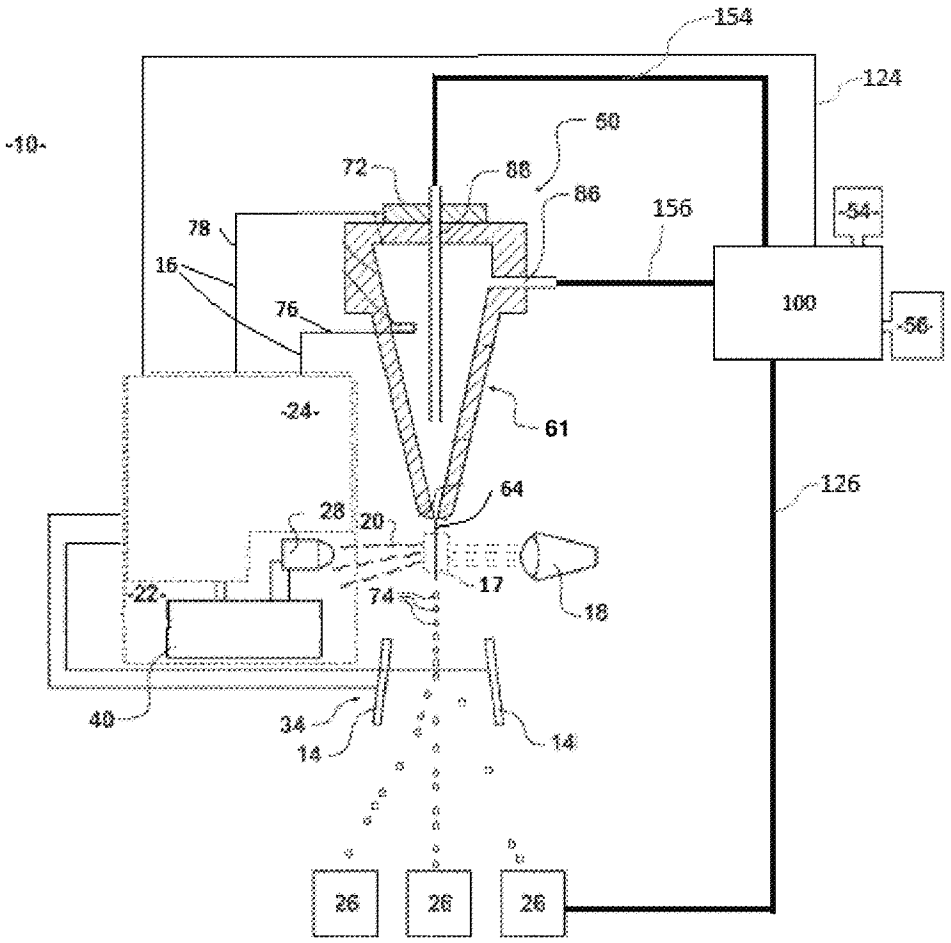
FIG. 1 schematically illustrates a particle processing instrument, such as a droplet sorter flow cytometer, in communication with a fluid handling system in accordance with certain aspects of this disclosure.

Now referring primarily to FIG. 1, an example of a fluid flow instrument 10 is schematically illustrated as a jet-in-air flow cytometer. The fluid flow instrument 10 may be a particle sorting apparatus, for example, a jet-in-air flow cytometer. The fluid flow instrument may include a sort head 50 including a nozzle assembly 61 for delivering particles to an inspection zone 17 and then to a separator 34. As another example, the fluid flow instrument 10 may be a microfluidic particle sorting apparatus.

As used herein, the term "particles" includes, but is not limited to, cells (e.g., blood platelets, white blood cells, tumorous cells, embryonic cells, spermatozoa, etc.), organelles, and multi-cellular organisms. Particles may include liposomes, proteoliposomes, yeast, bacteria, viruses, pollens, algae, or the like. Particles may include genetic material, RNA, DNA, fragments, proteins, fluorochrome conjugated antibodies, etc. Particles may also refer to non-biological particles, for example, synthetic beads (e.g., polystyrene), metals, minerals, polymeric substances, glasses, ceramics, composites, or the like. Depending on the application, the particles may be stained with a variety of stains, probes, or markers selected to differentiate particles or particle characteristics. For example, the particles may be stained with a fluorescent dye which emits fluorescence in response to an excitation source.

The sort head 50 may provide a means for delivering particles to the detection system 22 and more specifically to an inspection zone. The sort head 50 may include a nozzle assembly 61 for forming a fluid stream 64. The fluid stream 64 may be formed as an inner stream containing a sample fluid 54 and an outer stream comprising sheath fluid 56. The sample fluid 54 may include the cells or particles of interest. The sample fluid 54 may be delivered to the nozzle assembly 61 through a sample inlet 88. For example, an injection needle may deliver the sample fluid 54 centrally within the nozzle assembly 61. The sheath fluid 56 may be supplied to the nozzle assembly 61 through a sheath inlet 86. The sheath fluid 56 may form an outer stream which serves to hydrodynamically focus an inner stream of sample fluid 54 towards the downstream end of the nozzle assembly 61. In addition to the formation of the fluid stream 64, the nozzle assembly 61 may serve to orient the particles or cells in the sample fluid 54.

According to certain embodiments, the nozzle assembly 61 may have a nozzle orifice diameter of approximately 70 microns. According to other embodiments, the nozzle assembly 61 may have a nozzle orifice diameter of approximately 85 microns. Persons of ordinary skill in the art would recognize, given the benefit of this disclosure, that other nozzle orifice diameters may be suitable.

In order to perform the function of separating particles, the nozzle assembly 61 may further include an oscillator 72 for breaking the fluid stream 64 into droplets 74 downstream of the inspection zone. The oscillator 72 may include a piezoelectric crystal which perturbs the fluid stream 64 predictably in response to a drop drive signal 78. In FIG. 1, the drop drive signal 78 is represented by the electrical connection to the oscillator 72 carrying the drop drive signal 78.

The waveform shape, phase, amplitude, and frequency of the drop drive signal may directly affect the shape and size of the droplets as well as the presence of satellite droplets. For example, the length of the fluid stream included in each droplet 74 depends on the frequency of the drop drive signal 78. Similarly, the widths of the sample fluid stream and the sheath fluid stream may be affected by the pressure at which sample fluid 54 and sheath fluid 56 are supplied to the nozzle assembly 61, respectively. The amplitude, shape, phase, or frequency of the drop drive signal 78 may be modified during sorting in response to various operational parameters or event parameters.

Once a particle is delivered to the inspection zone, it may be interrogated with an electromagnetic radiation source 18, for example, an arc lamp or a laser. As one non-limiting example, the electromagnetic radiation source 18 may be a pulsed laser emitting photons at specified wavelengths. The wavelength of a pulsed laser may be selected based upon the particle characteristic of interest and may be selected to match an excitation wavelength of any stain or marker used to differentiate that characteristic.

Particles in the inspection zone which are interrogated with the electromagnetic radiation source 18 may produce a secondary electromagnetic radiation in the form of emitted (fluoresced) or reflected (scattered) electromagnetic radiation 20. The characteristics of the emitted or reflected electromagnetic radiation 20 may provide information relating to the characteristics of particles. The intensity of the emitted or reflected electromagnetic radiation 20 may be detected by a detection system 22 in a plurality of directions and/or at a plurality of specified wavelengths to provide a large amount of information about the interrogated particles.

The detection system 22 may comprise any number of detectors 28 to communicate signals to a processing unit 24 for differentiating particles and determining sort actions. A plurality of detectors 28 may be placed in a plurality of directions, including the rear, forward and/or side directions. Each detection path may include an optical configuration of collection lenses, reflective elements, or objective lenses in combination with splitters, dichroic mirrors, filters and other optical elements for detecting the intensities of various wavelengths collected from any particular direction. Optical configurations may also be employed for detecting light extinction or light scatter. In one embodiment, one or more of the detectors 28 may be a photomultipler tube (PMT) for producing electrical signals quantitatively representative of the intensity of the emitted or reflected electromagnetic radiation 20 incident upon the detector. Sensors other than PMTs, for example, photodiodes, may be employed. Detection system 22 may include one or more controllers 40 that communicate with one or more processing units 24.

In certain embodiments, a processing unit 24 may include all the acquisition and sort electronics required for operating the sort head 50 and the separator 34 in response to signals produced by the detectors 28. The processing unit 24 may comprise a computer in communication with a display device and an input device. The acquisition and sort electronics may be implemented on a PCIe board having a programmable processor such as a field programmable gate array (FPGA). The acquisition and sort electronics may be configured to display univariate histograms, bivariate plots and other graphical representations of acquired and/or processed signals on a display for a graphical user interface (GUI). Input devices may be associated with the GUI such as a monitor, a touch screen monitor, a keyboard, or a mouse for controlling various aspects of the sort head 50 or separator 34.

The acquisition and sort electronics may identify a signal pulse detected by one detector 28 and representing the presence of a particle of interest and may produce control signals 16 to control the sort head 50. The control signals 16 may control operational parameters set by a user at the GUI or may automatically and dynamically adjust parameters based on detected event parameters. For example, the control signals 16 may include a drop drive signal 78 for controlling the oscillator 72 and a charge signal 76 for controlling the charge of the fluid stream 64 based upon a sort decision.

Once a sort decision is determined for a particular particle, the fluid stream 64 may be charged with an appropriate charge just prior to the time a droplet 74 encapsulating the particle breaks off the fluid stream 64. The charged droplet 74 may be subjected to an electromagnetic field produced by the separator 34 for physically separating particles based upon a desired characteristic. In the case of a jet-in-air flow cytometer, the separator 34 may comprise deflection plates 14. The deflection plates 14 may include high polar voltages for producing an electromagnetic field that deflect charged droplets 74 into one or more collection containers 26.

Other particle delivery devices are contemplated for use here in, such as fluidic channels. For example, an alternative particle sorting device may include a sort head provided as a microfluidic chip. The microfluidic chip may include a sample inlet for introducing a sample fluid containing particles into a fluid channel passing through an inspection zone. The sample fluid may be focused within a laminar flow of a sheath fluid that is introduced into the microfluidic chip via a sheath inlet. After inspection at the inspection zone with a measurement system, for example, like the one described with respect to FIG. 1, particles in the fluid channel may be directed to a first flow path or to a second flow path. Although this system does not form jet-in-air droplets prior to the particles being sorted, as a fluid flow instrument its performance is still sensitive to variations in the pressures, flow rates, etc. of the fluid(s) provided to the device.

Still referring to FIG. 1, a fluid handling system 100 is provided to deliver fluid to and/or remove fluid from the fluid flow instrument 10. For example, the fluid handling system 100 may be in fluid communication with the sort head 50. As shown in FIG. 1, fluid handling system 100 may be coupled to fluid flow instrument 10 and may be in fluid communication with sort head 50, in particular with nozzle assembly 61, via sheath inlet 86 and sheath line 156. Fluid handling system 100 may also be in fluid communication with sort head 50, in particular with nozzle assembly 61, via sample inlet 88 and sample line 154. Even further, fluid handling system 100 may be in fluid communication with sort head 50, in particular with one or more fluid collection chamber(s) 26, via one or more collection line(s) 126.

Fluid handling system 100 may also be in communication with processing unit 24 via signal 124. Processing unit 24 may allow for fully automated operation of the fluid flow instrument and may provide outputs representing the status of the fluid flow instrument 10, the fluid handling system 100, and/or the characteristics of the sample being processed. Processing unit 24 may also be configured to receive inputs from an operator.

Figure 2:
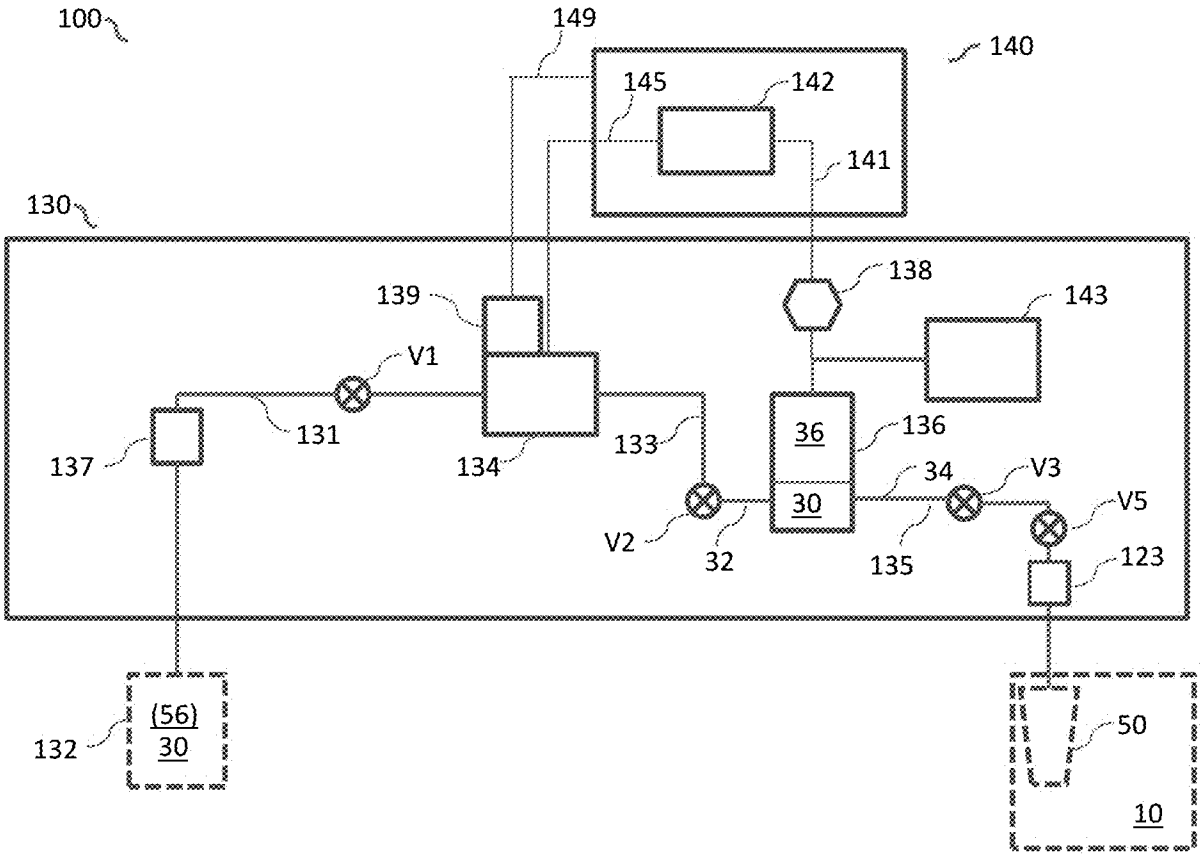
FIG. 2 illustrates a block diagram of an embodiment of a fluid handling system in accordance with certain aspects of this disclosure.

Referring now to FIG. 2, a fluid handling system 100 may be fluidically coupled to a fluid flow instrument 10. The fluid handling system 100 is provided to supply working fluid 30 to the fluid flow instrument 10 and to reduce the variation in one or more fluid flow parameters of the working fluid 30 provided to a fluid flow instrument 10. The fluid flow instrument 10 may be a particle processing instrument. The term "working fluid" refers to any fluid that is used as input to the fluid flow instrument. As a non-limiting example, the working fluid 30 may be a sheath fluid 56. As other non-limiting examples, the working fluid 30 may be a sample fluid 54, a reagent fluid, a cleaning fluid, a flushing fluid, etc. In preferred embodiments, the working fluid is a liquid, as opposed to a gas.

As shown in FIG. 2, the fluid handling system 100 may include a working fluid flow system 130 and a control system 140.

Still referring to FIG. 2, the working fluid flow system 130 may include a working fluid flow generator 134 and a pulse attenuator 136. Further, the working fluid flow system 130 may include a first working fluid flow path 131 delivering fluid to the working fluid flow generator 134, a second working fluid flow path 133 receiving fluid from the working fluid flow generator 134 and delivering fluid to the pulse attenuator 136, and a third working fluid flow path 135 receiving fluid from the pulse attenuator 136 and delivering fluid to the fluid flow instrument 10. The components of the working fluid flow system 130 are in fluid communication with each other.

The working fluid flow system 130 may be configured to be coupled to, and placed in fluid communication with, a working fluid supply 132. Specifically, the working fluid flow generator 134 may be configured to be coupled to, and placed in fluid communication with, the working fluid supply 132. A working fluid 30 may be contained within the working fluid supply 132. In general, the working fluid supply 132 may be of any configuration capable of containing an amount of working fluid 30. In certain applications, the working fluid supply 132 may be a fluid tank, a replaceable rigid container such as a bottle made of plastic or glass, or a replaceable flexible container such as a fluid bag. In a preferred application, the working fluid 30 is a sheath fluid 56 (see FIG. 1). Depending upon the application, other working fluids 30 (such as a sample fluid, cleaning fluid, etc.) may be provided. In certain preferred embodiments, the working fluid supply 132 is generally unpressurized, i.e., it is exposed to atmospheric pressure. The working fluid supply 132 may be fully enclosed and sealed against contamination, such that a sterile environment is provided and maintained.

The fluid handling system 100 may be configured to deliver a relatively stable stream of working fluid 30 to the fluid flow instrument 10. The working fluid flow generator 134 pulls working fluid 30 from the working fluid supply 132, via fluid flow path 131, and generates a pressurized working fluid flow stream 32. The pressurized working fluid flow stream 32 may have one or more flow parameters or characteristics that are relatively variable, and typically, not sufficiently stable to use as an input to flow-sensitive fluid flow instruments. The working fluid flow system 130 provides this relatively variable, pressurized flow of working fluid 30, via working fluid flow path 133, to working fluid pulse attenuator 136. The pulse attenuator 136 is designed to reduce and/or substantially eliminate these undesirable variations in the flow parameters associated with working fluid flow stream 32 and provide a smoother working fluid flow stream 34 having more consistent, less variable flow parameters. In other words, the working fluid 30 may enter the pulse attenuator 136 as a relatively variable working fluid flow stream 32, via fluid flow path 133, and exit the pulse attenuator 136 as a relatively stable working fluid flow stream 34. Thus, a substantially invariant, regulated or controlled working fluid flow stream 34 exits from fluid pulse attenuator 136 and is provided to fluid flow instrument 10, via working fluid flow path 135. The regulated or controlled working fluid flow stream 34 output from the fluid handling system 100 is suitable for input into fluid flow instruments 10 that are operationally sensitive to input fluid parameters and/or variations in the input fluid parameters.

The working fluid flow generator 134 may be a pump such as a single piston, dual piston, proportioning valve, diaphragm, peristaltic, etc. In preferred embodiments and referring to FIG. 3, a working fluid flow generator 134 may be a positive displacement pump such as a peristaltic pump 134*a*. Typically, a peristaltic pump has a rotor 134*b* (or head) mounted on a drive shaft. The rotor is provided with a plurality of rollers or shoes 134*c* at the outer circumference of the rotor 134*b*. The shoes 134*c* may be integrally formed with the rotor 134*b* or may be formed separately from and subsequently attached to the rotor. At least one flexible tube 134*d* is fitted between the rotor 134*b* and a wall of the pump casing. The shoes 134*c* compress and, in general, pinch closed the flexible tube(s) 134*d*. As the rotor 134*b* turns, the shoes 134*c* travel along the length of the flexible tube 134*d* that is fitted around the rotor 134*b*, thereby sequentially pinching and then releasing portions of the tube 134*d*. Fluid within the tube 134*d* is forced ahead of the traveling pinched portions and through the tube. When the tube 134*d* opens to its natural state after the passing of the shoes 134*c*, fluid is drawn into the tube 134*d*. The pump 134*a* may have a known flow rate to pump speed ratio, and thus, control of the speed of the pump drive shaft may correspond to a control of the flow rate of the fluid.

As a non-limiting example, the rotor 134*b* may be fitted with four evenly spaced shoes 134*c*. In general, the rotor 134*b* may have any number of shoes 134*c* associated therewith. Further, the shoes 134*c* need not be evenly spaced.

Figure 3:
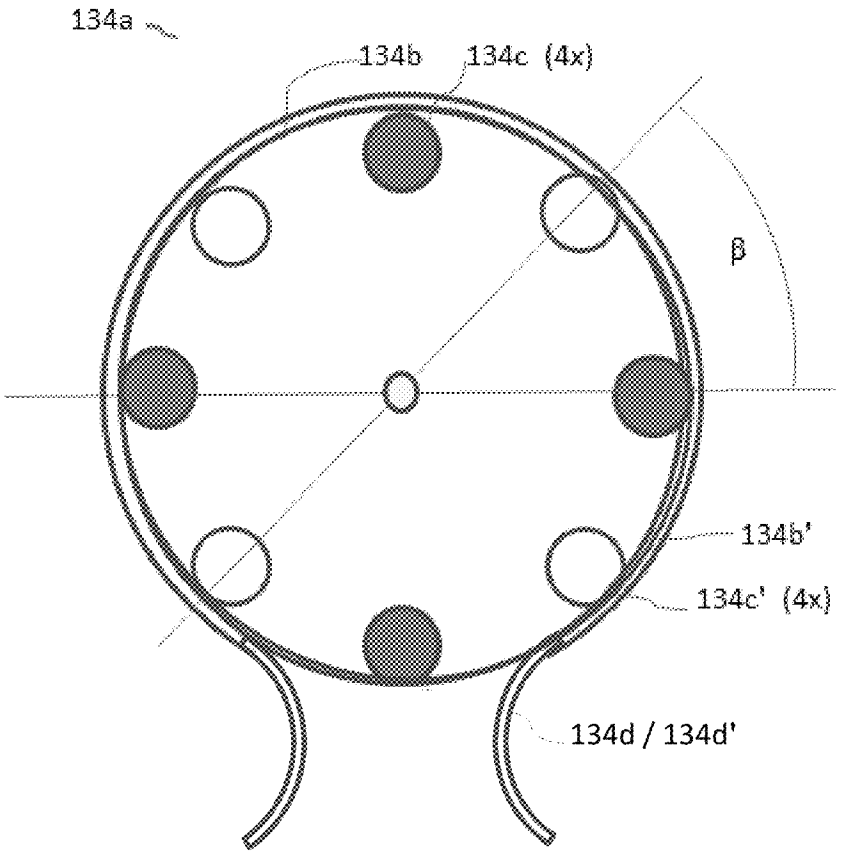
FIG. 3 schematically illustrates an embodiment of a fluid flow generator in accordance with certain aspects of this disclosure.

In certain preferred embodiments and still referring to FIG. 3, the pump 134*a* may be fitted with more than one rotor 134*b*, 134*b*' or head on a common drive shaft (i.e., a dual rotor configuration). Each rotor 134*b*, 134*b*' may be fitted with a plurality of spaced shoes or rollers 134*c*, 134*c*', respectively. In particularly preferred embodiments, the shoes 134*c* of the first rotor 134*b* may be staggered or offset by an angle β with respect to the shoes 134*c*' of the second rotor 134*b*'. In other words, a peristaltic pump 134*a* with an offset dual rotor configuration may be designed so that one rotor produces a maximum flow rate as the other rotor's flow rate reduces to its minimum. The upstream fluid flow channel may be split into two flexible tubes 134*d*, 134*d*' upstream of the pump 134. Each of the two flexible tubes 134*d*, 134*d*' may be associated with one of the two rotors 134*b*, 134*b*' such that the pulsed flow for the two flexible tubes 134*d*, 134*d*' is staggered. By combining the output from both flexible tubes into a common fluid flow channel downstream of the pump, the effect of the peristaltic pulsing may be significantly lessened. Alternatively, the pump may be a peristaltic pump having at least two rotors operating at a relative phase to one another.

Referring to FIG. 3 for example, should each rotor 134*b*, 134*b*' have four evenly spaced shoes 134*c*, 134*c*' (i.e., positioned 90 degrees apart), respectively, a pair of such rotors 134*b*, 134*b*' may be oriented on the common drive shaft with the shoes 134*c*, 134*c*' offset or staggered such that the shoes 134*c* of the first rotor 134*b* are space 45 degrees from the shoes 134*c*' of the second rotor 134*b*'. In other embodiments, each rotor 134*b*, 134*b*' may have any number of shoes 134*c*, 134*c*' and the offset between the shoes 134*c* of the first rotor 134*b* and the shoes 134*c*' of the second rotor 134*b*, 134*b*' may be greater than or less than 45 degrees. Each of the plurality of rotors 134*b*, 134*b*' may have the same diameter. Optionally, the rotors 134*b*, 134*b*' may have different diameters. Further, each rotor 134*b*, 134*b*' may be associated with one or more flexible tubes 134*d*, 134*d*'.

In yet further embodiments, the pump may be fitted with two rotors (as in FIG. 3) or with more than two rotors. For example, in some embodiments, the pump may be fitted with three or more rotors, each fitted with a plurality of spaced shoes or rollers which are staggered or offset relative to the spaced shoes or rollers of the other rotors.

Other schemes for staggering the pulses of a plurality of flows may include, for example, having two independent peristaltic pumps where a controller's algorithm monitors and adjusts the phase of one pump relative to the other pump. The control algorithm may be based on minimizing pressure pulses measured downstream. As another possible example, two flexible tubes may be run along a single rotor, wherein the two flexible tubes have different lengths between the rotor and a downstream junction. In certain embodiments, the difference in length would equal a half-pulse width.

According to certain embodiments, the working fluid flow generator 134 may be a peristaltic pump 134*a* providing a nominal output pressure of greater than approximately 15 psi, greater than approximately 20 psi, greater than approximately 30 psi, greater than approximately 40 psi, greater than approximately 50 psi, or even greater than approximately 60 psi. As a non-limiting example, the working fluid flow generator 134 may be a peristaltic pump 134 providing a nominal output pressure ranging from approximately 20 psi to approximately 50 psi. As another non-limiting example, the working fluid flow generator 134 may be a peristaltic pump 134 providing a nominal output pressure ranging from approximately 15 psi to approximately 30 psi.

Further, the working fluid flow generator 134 may be a single-rotor peristaltic pump 134*a* providing a nominal output pressure of approximately 20 to 45 psi with an output pulse fluctuation of up to approximately 8 to 9 psi (peak-to-peak). As another example, the working fluid flow generator 134 may be a single-rotor peristaltic pump 134*a* providing a nominal output pressure of approximately 20 to 30 psi with an output pulse fluctuation of up to approximately 1 to 3 psi (peak-to-peak). The output pulse fluctuation may be at least partly a function of the diameter of the flexible tubing. Tubing that is more restrictive, i.e., having a smaller diameter, may have a reduced flow rate and a reduce pressure fluctuation.

In some embodiments, a dual-head peristaltic pump 134*a* may provide a nominal output pressure of approximately 20 to 50 psi with an output pulse fluctuation of up to approximately 4 to 5 psi (peak-to-peak), for example when the flexible tubing for each path has a 1.6 mm inner diameter. In other embodiments, a dual-head peristaltic pump 134*a* may provide a nominal output pressure of approximately 20 to 50 psi with an output pulse fluctuation of up to approximately 2 to 3 psi (peak-to-peak), for example when the flexible tubing for each path has a 0.5 mm inner diameter. In certain embodiments, a dual-head peristaltic pump 134*a* may provide a nominal output pressure of up to approximately 60 psi with an output pulse fluctuation of less than or equal to approximately 1 psi (peak-to-peak) or even with an output pulse fluctuation of less than or equal to approximately 0.5 psi (peak-to-peak).

In general, the working fluid flow generator 134 may be sized to provide up to approximately 100 mL/min of working fluid 30. According to certain typical embodiments for use with microfluidic instruments, the working fluid flow generator 134 may be configured to provide a flow rate of up to approximately 15 mL/min. In preferred embodiments, for example for use with a droplet sorter, a working fluid flow generator 134 may be configured to provide a flow rate of up to approximately 10 mL/min. As non-limiting examples, a peristaltic pump 134*a* may be configured to provide a flow rate of between approximately 1 mL/min to approximately 10 mL/min, between approximately 5 mL/min to approximately 8 mL/min, or even between approximately 6 mL/min to approximately 7 mL/min.

Optionally, the working fluid flow generator 134 may be a pressure source regulated by a valve or other fluid limiting component.

Referring back to FIG. 2 and as would be known to persons of ordinary skill in the art given the benefit of this disclosure, the working fluid flow system 130 may include one or more fluid flow filters, valves, manifolds, gauges, quick disconnect fittings, etc. For example, a first working fluid valve V1 may be provided between the working fluid supply 132 and the working fluid flow generator 134. A second working fluid valve V2 may be provided between the working fluid flow generator 134 and the working fluid pulse attenuator 136. A third working fluid valve V3 may be provided between the working fluid pulse attenuator 136 and the fluid flow instrument 10 or sort head 50. As would be understood by a person of ordinary skill in the art, given the benefit of this disclosure, each valve or other element may be provided by one or more actual components. As another example, a filter 137 may be positioned downstream of the working fluid supply 132 and upstream of the working fluid flow generator 134. As a non-limiting embodiment, the filter may be a 0.2 micron particulate filter. As even another example, a pressure gauge (not shown) may be positioned downstream of the working fluid flow generator 134 to provide an operator with a real-time readout of the working fluid pressure. The working fluid system may be provided with tubing fluidically coupling the components. The tubing may have an inner diameter less than 0.064 inches. According to certain embodiments, the tubing may be flexible, pinch tubing and the valves may be pinch valves.

Still referring to FIG. 2, the fluid handling system 100 may include a pulse attenuator 136. The pulse attenuator 136 receives a pressurized working fluid flow stream 32 from the working fluid flow generator 134. Typically, the pressurized working fluid flow stream 32 received by the pulse attenuator 136 is pulsed and not sufficiently stable for delivery to the fluid flow instrument 10. Thus, the pulse attenuator 136 is controlled to adjust one or more parameters or characteristics of the working fluid flow stream 32 in order to provide a relatively constant fluid flow stream 34 to the fluid flow instrument 10.

Working fluid 30 delivered to the fluid flow instrument 10, i.e., working fluid flow stream 34, may be provided as a continuous flow or a variable (including intermittent) flow of an amount of fluid without limitation on volume, rate, pressure, duration, or the like. For example, the working fluid flow stream 34 may be intermittent with a flow rate ranging from between zero and a maximum flow rate value. In preferred embodiments, the working fluid flow stream 34 may be continuous with substantially negligible variation in one or more of the fluid flow characteristics. For example, the pressure and/or flow rate of the working fluid flow stream 34 may be controlled within certain practical operating limits of a particular instrument such as a liquid chromatograph or flow cytometer.

Thus, according to aspect of the disclosure, one or more fluid flow characteristics of a working fluid 32 may be regulated, controller or altered within the pulse attenuator 136. For example, a fluid flow pressure, a fluid flow rate, an amplitude or a frequency of a fluid pressure waveform, an amplitude or a frequency of a fluid flow rate waveform may be altered and/or controlled. As one non-limiting example, the working fluid flow generator 134 may generate pulsations in the working fluid flow stream 32 received by the pulse attenuator 136. These pulsations may have wave form(s) of particular frequency and amplitude. The fluid flow characteristics or parameters of the pulsation in the working fluid flow stream 32 may be regulated or altered within the pulse attenuator 136, as below described. Additionally, the actual level of at least one fluid flow characteristic may be assessed or measured for comparison with a pre-determined level (or desired level) of the same fluid flow characteristic.

In certain embodiments, the working fluid handling system 130 may include an air pump 143 in fluid communication with the pulse attenuator 136. The air pump 143 may be used to pre-charge or initially pressurize the pulse attenuator 136 as part of an initializing operation. According to an alternative embodiment, an air connection (not shown) may be provided so that an external source of compressed air may be fluidically-coupled to the pulse attenuator 136 in order to pre-charge the system 130. Once the system 130 has been pre-charged, the air pump 143 or the external source of compressed air is not necessary for the continued operation of the system.

In other embodiments, the working fluid handling system 130 may include a pressure release safety valve V5 downstream of the pulse attenuator 136 and upstream of the sort head 50. The pressure release safety valve V5 may be configured to be in communication with the control system 140. Alternatively, the pressure release safety valve V5 may also be configured to be independent from the control system 140. The independently configured pressure release safety valve SV5 may be configured to release pressure if the control system 140 errs, to avoid over pressurizing the working fluid handling system 130.

In certain embodiments, the working fluid handling system 130 may also include a filter 123 downstream of the pulse attenuator 136 and upstream of the sort head 50. As a non-limiting example, the filter 123 may be a 64 to 84 micron particle strainer which separates unwanted debris from the working fluid before the working fluid enters the sort head 50.

Figure 4:
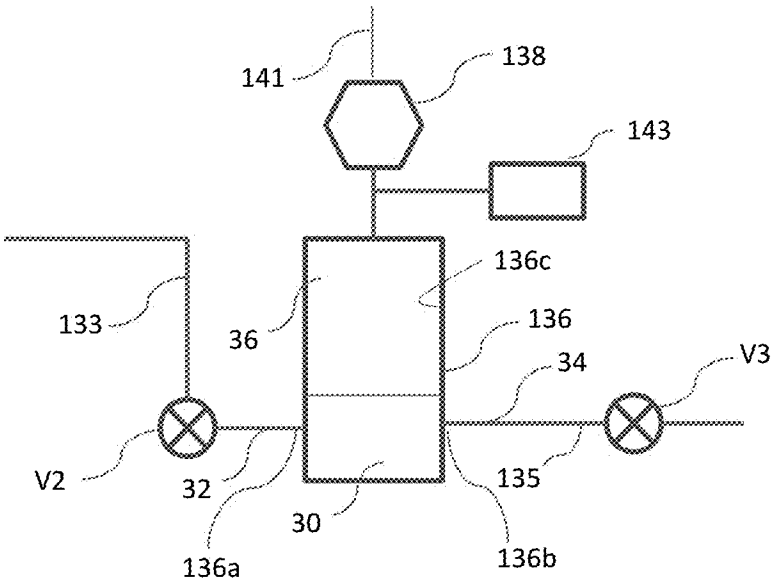
FIG. 4 illustrates a block diagram of an embodiment of a pulse attenuator with certain other components in accordance with certain aspects of this disclosure.

Now referring to FIG. 4, a working fluid pulse attenuator 136 may include an internal chamber 136*c*. The pulse attenuator 136 may be a substantially rigid container. Thus, the volume of the internal chamber 136*c* may be a constant volume. The internal chamber 136*c* accommodates both the working fluid 30 and the compressible gas 36. According to some embodiments, the volume of the pulse attenuator 136 may range from approximately 100 to approximately 450 mL. According to other embodiments, the volume of the pulse attenuator 136 may range from approximately 0.5 to approximately 5 mL. These examples are not meant to be limiting.

The pulse attenuator 136 has one or more working fluid flow inlets 136*a* and one or more working fluid flow outlets 136*b* for directing working fluid 30 through the pulse attenuator 136. The pulse attenuator 136 may be oriented such that the working fluid flow inlets 136*a* and outlets 136*b* are level with one another. Further, the working fluid flow inlets 136*a* and outlets 136*b* may be located in the lower half of the pulse attenuator 136. According to some embodiments, the working fluid flow inlets 136*a* and outlets 136*b* are located in the lower quartile of the pulse attenuator 136.

During operation, the pulse attenuator 136 is partially filled with an amount of working fluid 30. The amount of working fluid 30 within the pulse attenuator 136 is generally sufficient to cover the working fluid flow inlets 136*a* and outlets 136*b*. The remainder of the volume of the pulse attenuator 136 is filled with a compressible gas 36. Thus, the pulse attenuator 136 may be oriented such that a volume for accommodating the compressible gas 36 is above the level of the working fluid flow inlets 136*a* and outlets 136*b*. In preferred embodiments, the compressible gas is air. In preferred embodiments, there is no membrane or other element (deformable or non-deformable) separating the working fluid 30 from the compressible gas 36. Thus, the pulse attenuator may be configured as a single, undivided volume. Optionally, in other embodiments, the working fluid pulse attenuator 136 may have a membrane or other flexible barrier separating the working fluid 30 from the compressible gas 36. The flexible barrier may isolate the working fluid from the gas 36 to protect the working fluid 30 from potentially detrimental interactions with the gas 36 or vice versa. The flexible barrier may rise or fall with the fluid level within the pulse attenuator 136 without influencing the pressure within the pulse attenuator 136.

According to certain embodiments, the pulse attenuator 136 may have a total volume ranging from approximately 100 mL to approximately 300 mL. This total volume range may be particularly appropriate when the working fluid is a sheath fluid. According to some embodiments, the pulse attenuator 136 may have a total volume ranging from approximately 150 mL to approximately 250 mL. By way of non-limiting example, the volume of the pulse attenuator may range from approximately 180 mL to approximately 220 mL. Depending upon the desired working pressure, the amount of the working fluid 30 within the pulse attenuator 136 may range from approximately 50 milliliters ("mL") to approximately 100 mL and the volume of the compressible gas within the pulse attenuator 136 may range from approximately 100 mL and approximately 250 mL. For example, with a total internal volume of the pulse attenuator 136 of approximately 210 mL (having a specified dead volume of 190 mL), a working pressure of approximately 25 psi is achieved when the volume of the working fluid 30 is approximately 75 mL.

The volume ratio of the working fluid to the compressible gas is dependent upon the desired working pressure set point, i.e., a higher set point fluid pressure will compress the trapped air to a smaller volume). The ratio of the volume of the working fluid 30 to the compressible gas may range from approximately 1:1 to approximately 1:10. As examples, the volume of the working fluid 30 may range from approximately 50 mL to approximately 150 mL and the volume of the compressible gas may range from approximately 100 mL to approximately 250 mL. The ratio of working fluid 30 to compressible gas volume may range from approximately 1:1 to approximately 1:6. These ranges and ratios are not intended to be limiting.

Now referring to both FIGS. 2 and 4, the pulse attenuator 136 may further include one or more fluid parameter sensor(s) 138. The fluid parameter sensor(s) 138 may directly or indirectly sense a value of one or more flow parameters of the compressible gas 36 and/or the working fluid 30 within the pulse attenuator 136. Additionally and/or alternatively, the fluid parameter sensor(s) 138 may directly or indirectly sense a variation or change in one or more flow parameters of the compressible gas 36 and/or the working fluid 30 within the pulse attenuator 136. The fluid parameter sensor 138 may generate a fluid parameter signal 141 which varies based upon directly or indirectly sensed values and/or variations in the compressible gas 36 and/or the working fluid 30 within the pulse attenuator 136. Fluid parameters or characteristics such as pressure, volume, flow rate, temperature, etc. may be sensed.

According to one embodiment, the fluid parameter sensor 138 may be a pressure transducer that generates a fluid parameter signal 141. In the embodiment of FIG. 4, the pressure transducer measures or senses the pressure of the air within the pulse attenuator 136. Other fluid parameter sensors 138 known to persons of ordinary skill in the art given the benefit of this disclosure may be used.

The pulse attenuator 136 regulates or controls one or more fluid flow parameters of the working fluid 30 such that the working fluid flow stream 32 entering the pulse attenuator 136 has different fluid flow parameters from the working fluid flow stream 34 exiting the pulse attenuator 136. According to certain aspects, the pulse attenuator 136, in conjunction with the control system 140, may also adjust one or more fluid flow parameters of the working fluid 30 by adjusting one or more parameters of the working fluid flow generator 134.

Again referring to FIG. 2, the fluid handling system 100 may include a control system 140. The control system 140 may include a fluid controller 142 that runs a control application. The fluid controller 142 is in communication with the pulse attenuator 136. Specifically, the fluid controller 142 may receive signals 141 from the sensor 138 associated with the pulse attenuator 136.

Even further, the control system 140 may be in communication with the processor 124 coordinate the control of the fluid handling system 100 with the operation of the fluid flow instrument 10.

The fluid controller 142 may be in communication with the working fluid flow generator 134 to regulate or control a flow parameter of the working fluid flow stream 32 flowing from the working fluid flow generator 134. For example, the fluid controller 142 may operate to control the flow rate of the working fluid flow stream 32 flowing from the working fluid flow generator 134. In general, the fluid controller 142 may operate to adjust the pressure, volume, rate, or other working fluid characteristic of the working fluid flow stream 32. For example, the fluid controller 142 may operate to intermittently or continuously supply working fluid 30 to the pulse attenuator 136. As described above, the working fluid flow generator 134 may be a pump. As a non-limiting example, the fluid controller 142 may control the speed of the pump's motor.

The fluid controller 142 may be implemented as a computer which receives, analyzes and/or sends signals to or sensors, displays, regulators, valves, and other active components of the fluid handling system. The computer may be a conventional computer, a distributed computer, or any other type of computer which may contain all or a part of the elements described or shown to accomplish the functions described herein. The computer may include an operating system and a controller application. Functionalities of the control fluid controller application may be implemented as an application specific integrated chip (ASIC) or on a programmable gate array (FPGA), or the like. The controller application loaded onto the computer produces a machine.

In preferred embodiments, fluid controller 142 may include a proportional-integral-derivative (PID) controller. The PID controller may be programmed to receive signals from the pulse attenuator 136 and send signals to the working fluid flow generator 134. Further, the fluid controller 142 may be programmed to send and/or receive signals continuously from any of these components. The term "continuously" in this context refers to commands being updated at least two (2) times per second. According to some embodiments, the signals may be updated at least three (3) times per second. When finer control of the pressure characteristics of the working fluid 30 supplied to the nozzle assembly 61 is desired, the signals may be updated more than 10 times per second, more than 20 times per second, more than 50 times per second, or even more than 100 times per second. As one example, an Omega Engineering PID controller, model no. CNI1654-C24-DC, may be suitable.

Thus, the fluid parameter sensor 138 may send a signal 141 to the control system 140 that reflects a variation in a fluid parameter of the air and/or the working fluid 30 within the pulse attenuator 136. The control system 140 may control one or more fluid parameters of the working fluid flow stream 32 to regulate or control the fluid parameters of the working fluid flow 34 exiting the pulse attenuator 136 and being provided to the fluid flow instrument 10.

Thus, according to exemplary embodiments, the control system 140 may operate to maintain the compressible gas (e.g., air) within the pulse attenuator 136 at a constant pressure ($P_A$).

According to certain aspects, upon receiving a sensor signal 141 indicating a change in a fluid parameter within the pulse attenuator 136, the fluid controller 142 may provide a signal 145 to the working fluid flow generator 134 to continuously or intermittently adjust delivery of the working fluid 30 to the pulse attenuator 136. The fluid controller 142 may thereby intermittently or continuously adjust fluid characteristics (e.g., volume, pressure, flow rate, or the like) of the working fluid flow stream 32 delivered from the working fluid flow generator 134 to the pulse attenuator 136.

The fluid controller 142 may be programmed to receive and/or determine the magnitude of the sensor signal 141, a magnitude of the change in the sensor signal 141, a magnitude of the rate of change of the sensor signal 141, etc. and based on this information, provide a control signal 145 to the working fluid flow generator 134. The control signal 145 may control the absolute speed, a change in speed, a rate of change in speed, etc. of a motor of the working fluid flow generator 134.

Thus, according to some aspects, a method of controlling a fluid handling system 100 to supply a working fluid 30 to a fluid flow instrument 10 may include receiving a sensor signal 141 from a sensor 138 indicative of a pressure within the pulse attenuator 136 containing the working fluid 30. The method may include sending a control signal 145 to a working fluid flow generator 134 positioned upstream of the pulse attenuator 136. The control signal 145 may be determined as a function of the sensor signal(s) 141. According to some embodiments, the control signal 145 may be proportional to a change in the value of the sensor signal 141 from a predetermined and/or nominal sensor signal value. As yet another example, the control signal 145 may be a function of a rate of change of the sensor signal 141.

When the pressure $P_A$ of the compressible gas within the pulse attenuator departs from the nominal, set point pressure, the fluid parameter sensor 138 may send signals 141 to fluid controller 142, which in turn may send signals 145 to the working fluid flow generator 134. The working fluid flow generator 134 may then increase or decrease the flow rate of the working fluid flow stream 32 facilitate returning the pressure $P_A$ to its set point. In other words, the fluid parameter sensor 138 may generate signal variation values 141 and sends these signals 141 to fluid controller 142. Fluid controller 142 may generate working fluid flow generator adjustment signals 145, based on input from signals 141, and sends these adjustment signals 145 to working fluid flow generator 134. The operation of the working fluid flow generator 134 may thereby be regulated so as to maintain a substantially constant pressure and flow rate of the working fluid flow stream 34 exiting from the pulse attenuator 136.

Thus, according to some embodiments, the fluid controller 142 may be configured to maintain the pressure within the pulse attenuator 136 to within plus/minus 0.005 psi of a nominal pressure, to within plus/minus 0.003 psi of a nominal pressure, to within plus/minus 0.002 psi of a nominal pressure, or even to within plus/minus 0.0015 psi of a nominal pressure.

According to other embodiments, the fluid controller 142 may be configured to maintain the pressure at the output from the pulse attenuator 136 to within plus/minus 0.10 percent of a nominal pressure. In more preferred embodiments, the fluid controller 142 may be configured to maintain the pressure at the output from the pulse attenuator 136 to within plus/minus 0.05 percent of a nominal pressure, to within plus/minus 0.03 percent of a nominal pressure, to within 0.02 percent of a nominal pressure, to within plus/minus 0.01 percent of a nominal pressure, or even to within plus/minus 0.005 percent of a nominal pressure.

In this manner, working fluid flow stream 34 exiting from the pulse attenuator 136 may have a substantially constant flow rate and/or a substantially constant pressure profile, even if the incoming working fluid flow stream 32 entering the pulse attenuator 136 may have a variable flow rate and/or a variable pressure profile. The variable flow rate and/or variable pressure profile of the incoming working fluid flow stream 32 may be an artifact of the operation of the working fluid flow generator 134. Thus, the pulse attenuator 136 decreases variations in flow parameters of the incoming working fluid flow stream 32.

According to certain embodiments, the pressure pulses of the working fluid flow stream 34 exiting from the pulse attenuator 136 may range from approximately 0.001 psi to approximately 0.10 psi (peak-to-peak). More typically, the pressure pulses of the working fluid flow stream 34 attenuated by pulse attenuator 136 may range from approximately 0.01 psi to approximately 0.06 psi (peak-to-peak). According to certain preferred embodiments, the attenuate pressured pulses may range from approximately 0.003 psi to approximately 0.004 psi (peak-to-peak).

According to certain embodiments, the pressure pulses of the working fluid flow stream 32 entering the pulse attenuator 136 may be attenuated by approximately 99 percent. In other words, the ratio of the nominal pressure pulses of the working fluid flow stream 34 exiting the pulse attenuator 136 to the nominal pressure pulses of the working fluid flow stream 32 entering the pulse attenuator 136 may be approximately 100:1. The pressure pulse (peak-to-peak) of the working fluid flow received into the pulse attenuator may be attenuated by at least a factor of 10 relative to the pressure pulse (peak-to-peak) of the working fluid flow exiting the pulse attenuator, may be attenuated by at least a factor of 100, or may even be attenuated by a factor of 1000 or more. The ratio of the pressure pulse fluctuations of the outlet flow of working fluid entering the pulse attenuator to the pressure pulse fluctuations of the pulsed flow of working fluid exiting the pulse attenuator may range from approximately 50:1 to approximately 200:1. The ratio of the pressure pulse fluctuations of the outlet flow of working fluid entering the pulse attenuator to the pressure pulse fluctuations of the pulsed flow of working fluid exiting the pulse attenuator may be greater than or equal to approximately 100:1.

Thus, according to certain preferred embodiments, upon receiving a signal 141 indicating a change in a fluid parameter of the working fluid flow stream 32 within the pulse attenuator 136, the fluid controller 142 may provide an adjustment signal 145 to the working fluid flow generator 134 to continuously or intermittently control delivery of the working fluid 30. For example, the fluid controller 142 may provide an adjustment signal 145 to control the rate that working fluid 30 is delivered to the pulse attenuator 136. Specifically, as a non-limiting example, the adjustment signal 145 may control the speed of a peristaltic pump 134*a*.

Initially, the pulse attenuator 136 is unpressurized. Referring to FIG. 2, in certain embodiments, in an initializing operation, air pump 143 is activated and air is pumped into pulse attenuator 136 to "pre-charge" the volume to an initializing pressure ($P_0$). This initializing pressure $P_0$ may be greater than 50% of the set-point or nominal working pressure. During this pre-charging operation, valves V2 and V3 are closed and there is no working fluid in the pulse attenuator. Subsequently, while still in the initializing operation, valve V3 downstream of the pulse attenuator 136 may be closed and valves V1 and V2 may be opened. The working fluid flow generator 134 is turned on and working fluid 30 is drawn from working fluid supply 132 and delivered to the pulse attenuator 136. As the pulse attenuator 136 begins to fill with working fluid 30, the pressure within pulse attenuator (as measured, for example, by pressure transducer 138) begins to rise above the pre-charged initializing pressure $P_0$. The working fluid flow generator 136 continues to deliver working fluid 30 to pulse attenuator 136 until a set point, nominal, or working pressure within the pulse attenuator 136 is reached. The volume for accommodating the compressible gas 36 is positioned above the level of the working fluid flow inlets 136*a* and outlets 136*b*. For certain specific applications, this set-point pressure may range from approximately 10 to 50 psi. For other applications, this set-point pressure may range from approximately 10 to 30 psi, from 20 to 30 psi, from 20 to 40 psi, from 30 to 50 psi, or even from 40 to 50 psi.

Thus it can be seen that the fluid handling system 100 does not require a separate source of pressurized gas and does not require any gas supply components or gas supplying facilities in order to develop a set-point pressure within the pulse attenuator 136. The fluid handling system 100 thus provides an efficient, streamlined, relatively-inexpensive system for attenuating fluid pulses in a working fluid being supplied to a fluid flow instrument 10 that is operationally sensitive to input fluid parameters and/or variations in the input fluid parameters.

Additionally, the fluid handling system 100 may be easily installed and/or removed by simply connecting and/or disconnecting the flexible tubing to/from the working fluid supply 132 and to/from the fluid flow instrument 10. Further, one or more portions of the "wetted" fluidic path (i.e., those components of the fluid handling system 100 that contact the working fluid 30) may be easily installed and/or removed by connecting and/or disconnecting the flexible tubing from the remainder of the fluid handling system 100. Even further, the entire wetted fluidic path from the working fluid supply 132 to the fluid flow instrument 10 may be easily installed and/or removed by connecting and/or disconnecting the flexible tubing to/from the working fluid supply 132 and to/from the fluid flow instrument 10. This quick and easy installation and/or removal of the wetted fluidic path (or portions thereof) of the fluid handling system 100 may be facilitated by the use of pinch valves, the peristaltic pump, quick connect fittings, etc. If desired one or more of the components, for example, the pulse attenuator 136 and/or the flexible tubing 131, 133, 135, may be cleaned and sterilized offline and then reinstalled within the fluid handling system 100. Even further, a plurality of interchangeable wetted fluidic path assemblies and/or subassemblies may be provided to minimize downtime and/or to allow various different configurations to be exchanged. For example, different subassemblies having various tubing diameters and/or filter configurations may be provided. If desired, the entire wetted fluidic path (or portions thereof) may be disposable. If desired, replaceable and interchangeable assemblies of the entire wetted fluidic path (or portions thereof) may be provided as kits. These kits may be prepackaged, may be sterilized or sterilizable, and may be disposable or reusable.

During a particle processing operation, in addition to valves V1 and V2 being opened, valve V3 is also opened and working fluid 30 is supplied to the fluid flow instrument 10 as a regulated working fluid flow stream 34. Fluid controller 142 receives signals 141 from the pressure transducer 138 associated with the pulse attenuator 136 and sends control signals 145 to working fluid flow generator 134.

Figure 5:
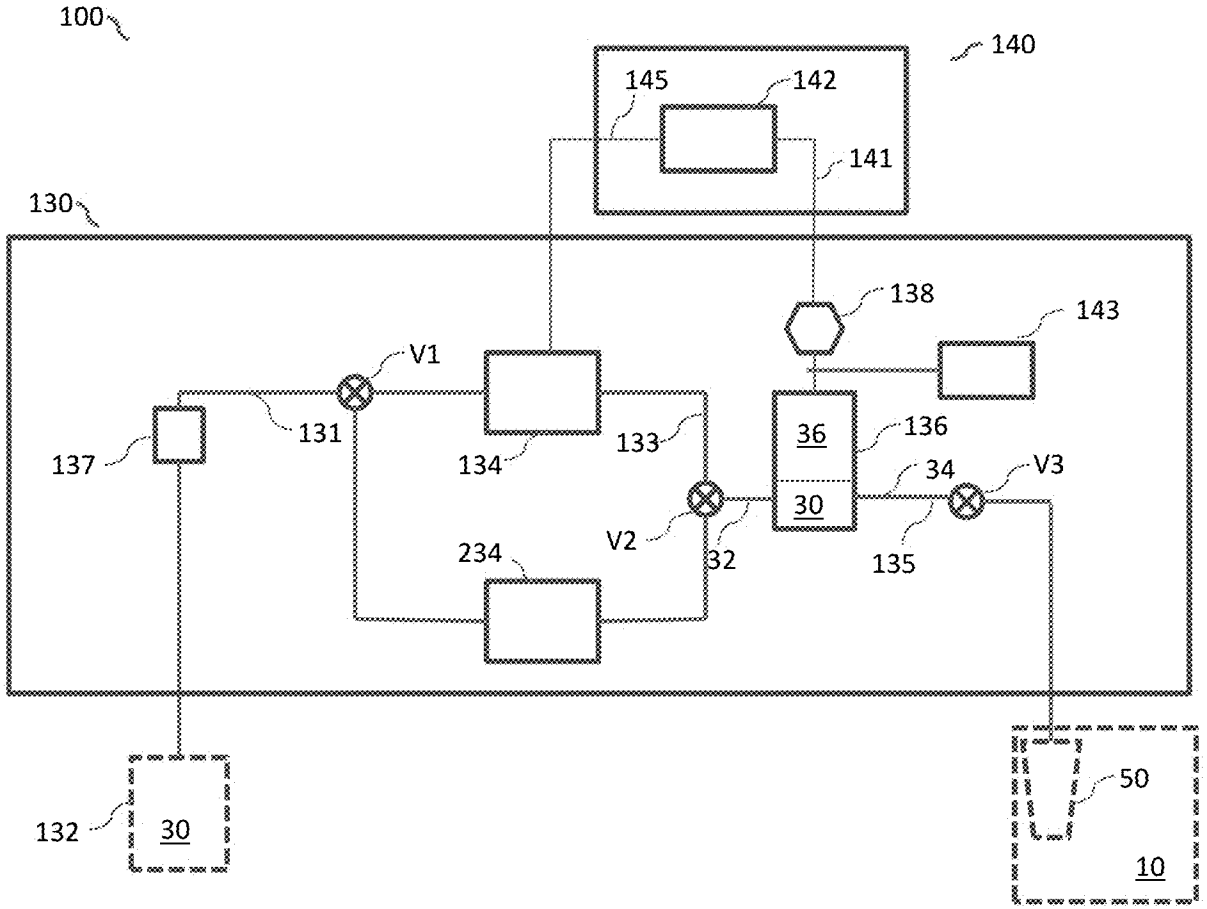
FIG. 5 illustrates a block diagram of an embodiment of a fluid handling system in accordance with certain aspects of this disclosure.

In an alternative embodiment shown in FIG. 5, an auxiliary flow generator 234 may be used to initially pressurize the pulse attenuator 136. The auxiliary flow generator 234 may be provided in parallel with the primary working fluid flow generator 134 and may have a higher flow rate capability than the primary working fluid flow generator 134 so that initializing the fluid handling system 100 may occur more rapidly. For this initial filling of the pulse attenuator, valve V1 may allow flow of working fluid 30 to auxiliary flow generator 234, while blocking flow of working fluid 30 to primary working fluid flow generator 134. Valve V2 may allow working fluid 30 to flow from auxiliary flow generator 234 to the pulse attenuator, while blocking any flow to primary working fluid flow generator 134.

Once the pulse attenuator 136 has been pressurized to its nominal operating pressure, the fluid handling system 100 may be placed in a standby mode, wherein there is no working fluid being provided to the fluid flow instrument, but the pressure within the pulse attenuator 136 is maintained at its nominal operating pressure. In some embodiments, once the pulse attenuator 136 has been pressurized to its nominal operating pressure valve V1 may be switched to allow flow of working fluid 30 to primary working fluid flow generator 134, while blocking flow of working fluid 30 to auxiliary flow generator 234 and valve V2 may be switched to allow working fluid 30 to flow from primary working fluid flow generator 134 to the pulse attenuator, while blocking any flow to auxiliary fluid flow generator 234. During standby mode, the fluid controller 142 may be operational to monitor and maintain the pressure within the pulse attenuator 136 at its nominal operating pressure, e.g., using the primary working fluid flow generator 134. During a particle processing operation, valve V3 may be opened and working fluid 30 is supplied to the fluid flow instrument 10 as a regulated working fluid flow stream 34. Fluid controller 142 receives signals 141 from the pressure transducer 138 associated with the pulse attenuator 136 and sends control signals 145 to working fluid flow generator 134.

Figure 6:
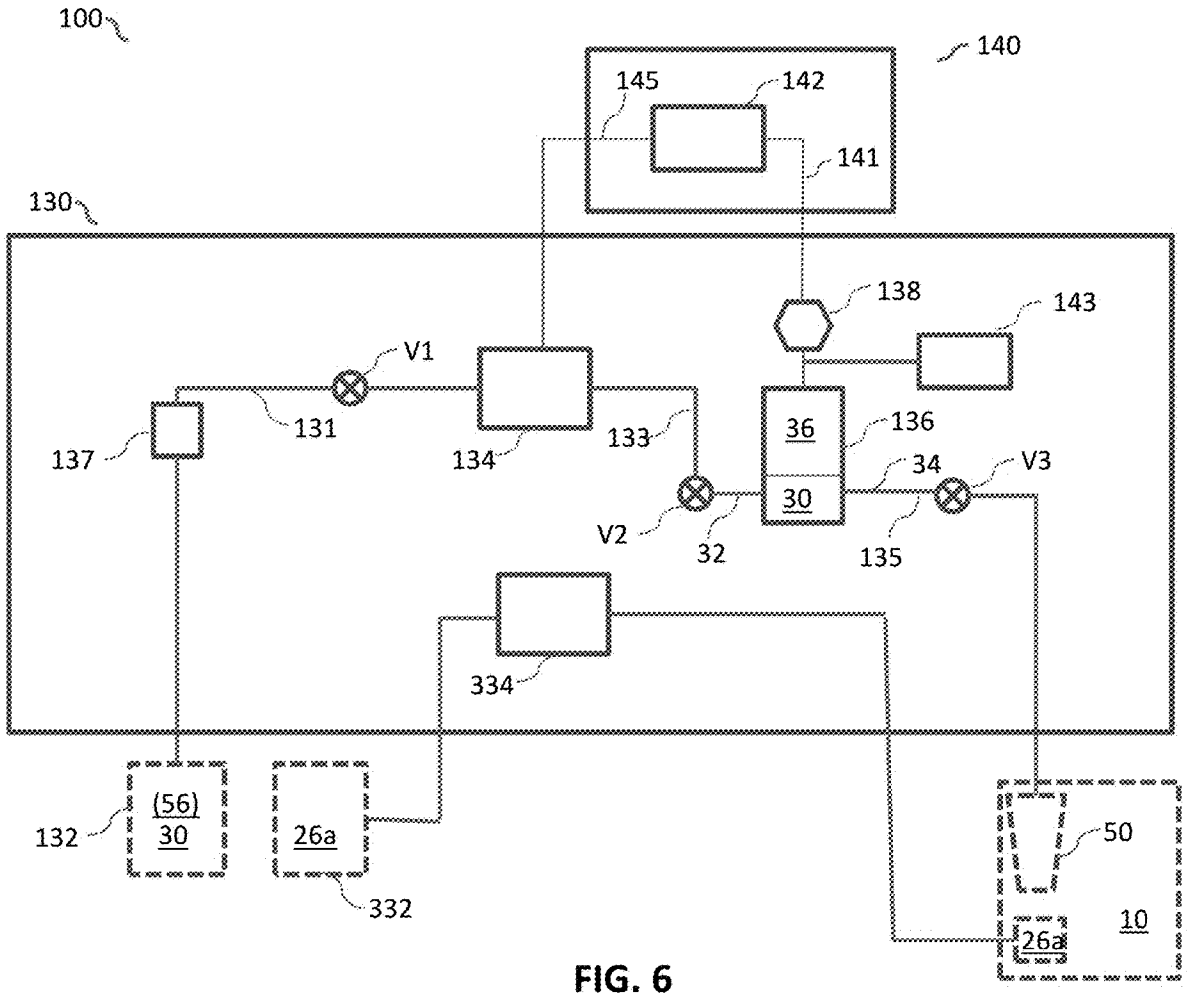
FIG. 6 illustrates a block diagram of an embodiment of a fluid handling system in accordance with certain aspects of this disclosure.

In an alternative embodiment shown in FIG. 6, a collection pump 334 may be provided to collect fluid 26*a* processed through fluid flow instrument 10 into a fluid collection reservoir 332. In a preferred embodiment, collection pump 334 may be a peristaltic pump or other positive displacement pump so that a predictable flow rate for removing processed fluid 26*a* is provided.

Figure 7:
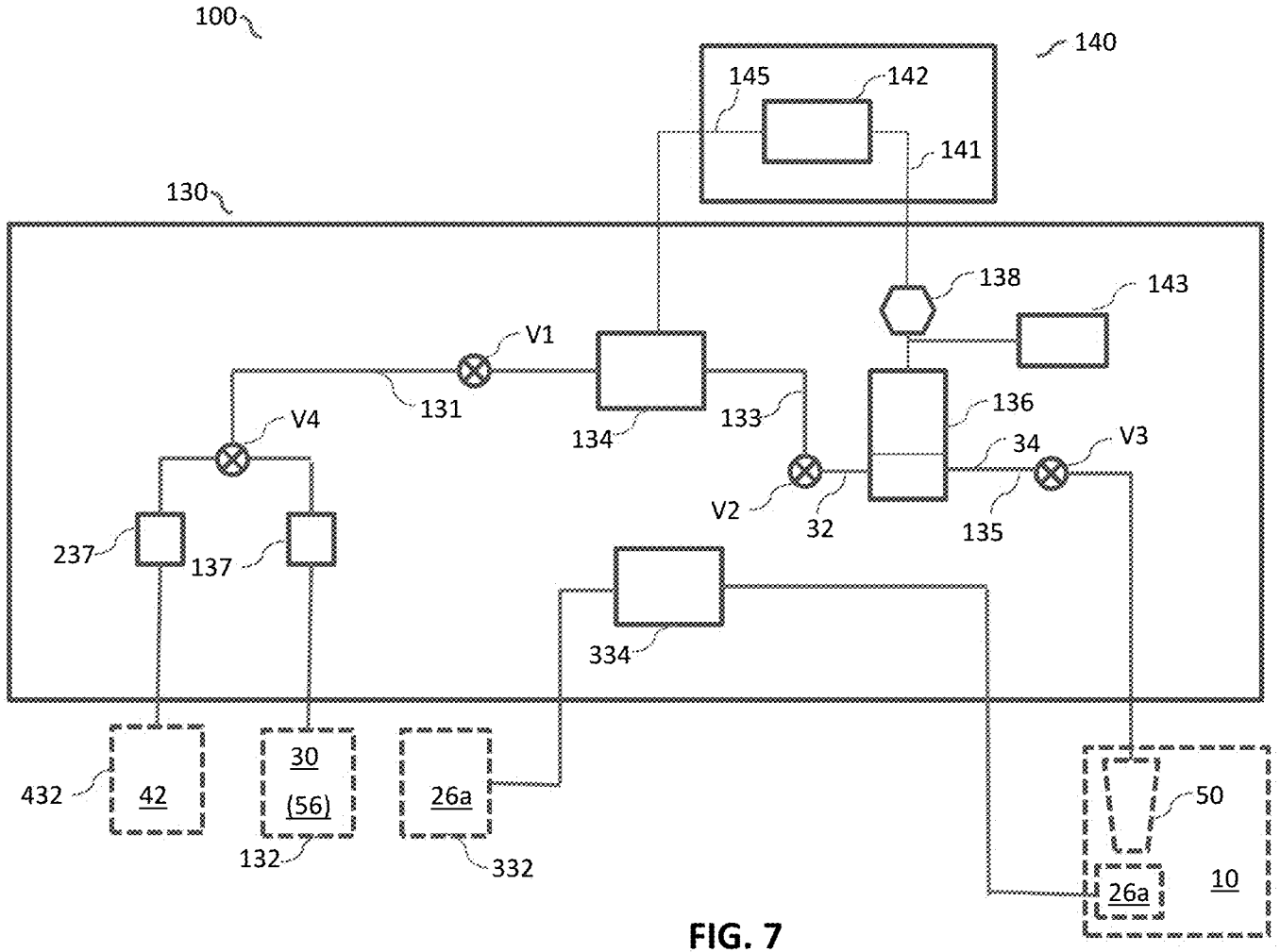
FIG. 7 illustrates a block diagram of an embodiment of a fluid handling system in accordance with certain aspects of this disclosure.

Referring to FIG. 7, in even another alternative embodiment of the fluid handling system 100, a cleaning fluid supply 432 including an amount of cleaning fluid 42 may be supplied. With valves V1, V2 and V3 open and valve V4 toggled to open the cleaning fluid flow path and close the working fluid flow path, cleaning fluid 42 may be pumped through the system via fluid flow generator 134 and collection pump 334. If fluid handling system 100 includes an auxiliary fluid flow generator 234, as shown in FIG. 5, then cleaning fluid 42 may also be circulated through the fluid handling system 100 via the auxiliary fluid flow generator 234. Similar to filter 137 in the working fluid flow path, a filter 237 may be positioned in the cleaning fluid flow path, downstream of the cleaning fluid supply 432 and upstream of the working fluid flow generator 134 and/or auxiliary fluid flow generator 234 (if any). In FIG. 7, fluid 26*a* refers to the cleaning fluid that is collected after being pumped through the system and the working fluid 30 may be sheath fluid 56.

Figure 8:
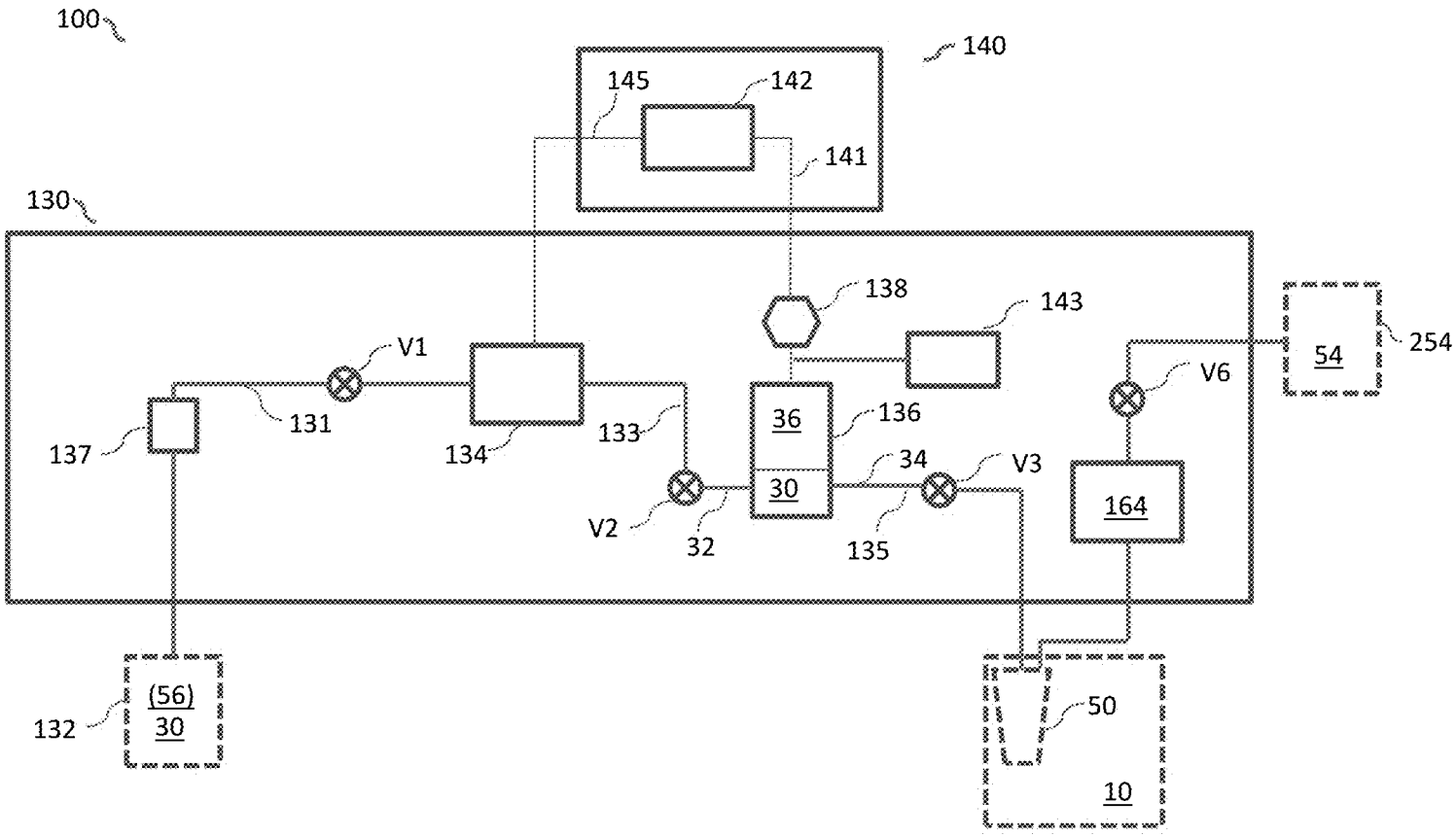
FIG. 8 illustrates a block diagram of an embodiment of a fluid handling system in accordance with certain aspects of this disclosure.

Referring now to FIG. 8, fluid handling system 100 may also include a sample fluid flow generator 164 for delivering sample fluid 54 from a sample fluid supply 254 to fluid flow instrument 10 (e.g., to sort head 50). Sample fluid flow generator 164 may be any suitable fluid flow delivery device, including for example a peristaltic pump. A valve V6 may be included to assist in the control of the sample fluid flow.

Figure 9:
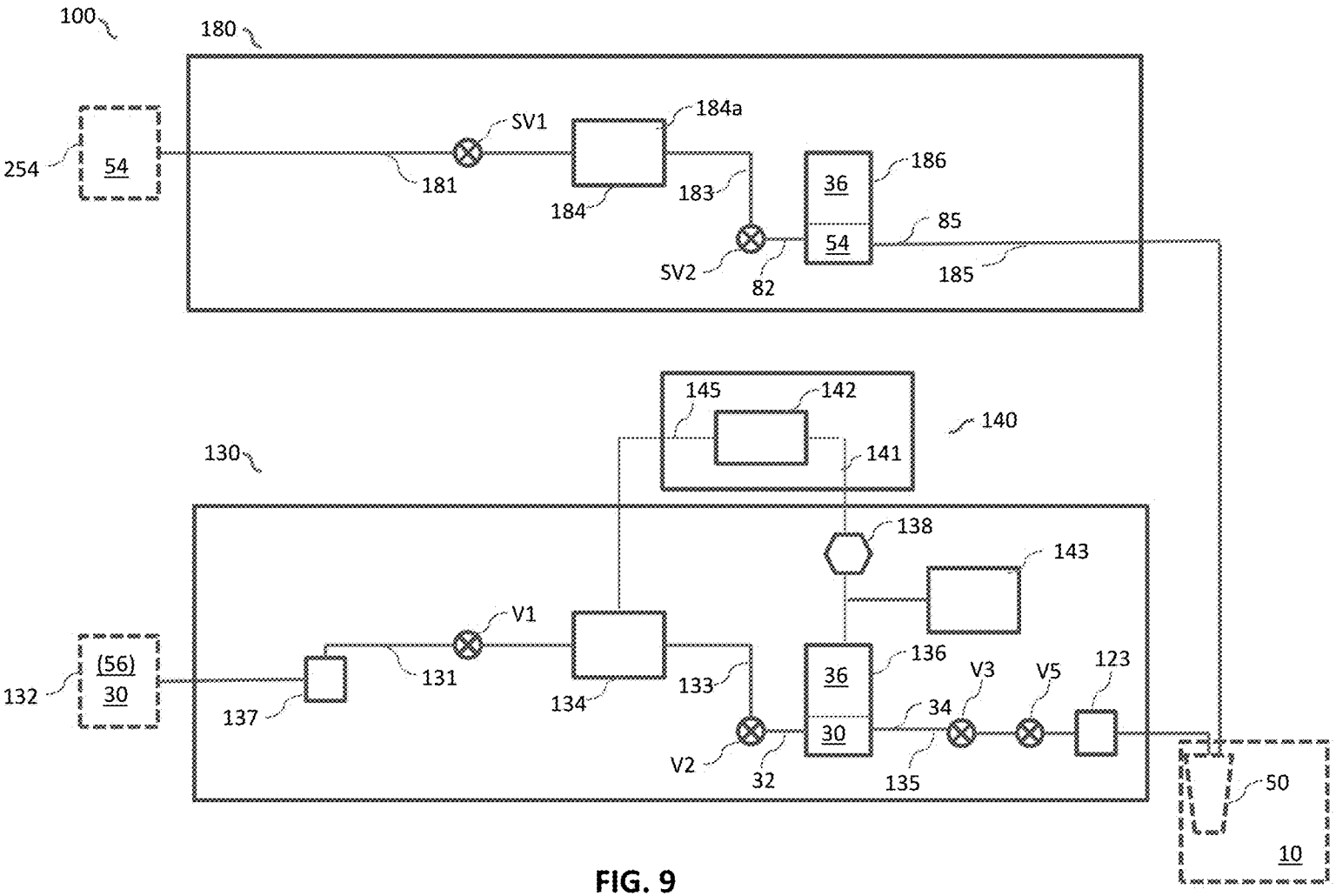
FIG. 9 illustrates a block diagram of an embodiment of a fluid handling system including both a working fluid handling system and a sample fluid handling system in accordance with certain aspects of this disclosure.

According to certain aspects and as schematically shown in FIG. 9, fluid handling system 100 may include a sample fluid flow system 180 in addition to the working fluid flow system 130. Sample fluid flow system 180 may include a sample fluid flow generator 184 and a sample pulse attenuator 186. Further, the sample fluid flow system 180 may include a first sample fluid flow path 181 delivering fluid to the sample fluid flow generator 184, a second sample fluid flow path 183 receiving fluid from the sample fluid flow generator 184 and delivering fluid to the sample pulse attenuator 186, and a third sample fluid flow path 185 receiving fluid from the sample pulse attenuator 186 and delivering fluid to the fluid flow instrument 10. The components of the sample fluid flow system 180 are in fluid communication with each other.

The sample fluid flow system 180 may be configured to be coupled to, and placed in fluid communication with, a sample fluid supply 254. Specifically, the sample fluid flow generator 184 may be configured to be coupled to, and placed in fluid communication with, the sample fluid supply 254. A sample fluid 54 may be contained within the sample fluid supply 254. In general, the sample fluid supply 254 may be of any configuration capable of containing an amount of sample fluid 54.

The sample fluid flow system 180 may be configured to deliver a relatively stable stream of sample fluid 54 to the fluid flow instrument 10. The sample fluid flow generator 184 pulls sample fluid 54 from the sample fluid supply 254, via fluid flow path 181, and generates a pressurized sample fluid flow stream 82. The pressurized sample fluid flow stream 82 may have one or more flow parameters or characteristics that are relatively variable, and typically, not sufficiently stable to use as an input to flow-sensitive fluid flow instruments. The sample fluid flow generator 184 may provide a nominal output pressure of approximately 10 to 50 psi with an output pulse fluctuation of up to approximately 1.0 to 6.0 psi (peak-to-peak). The output pulse fluctuation may be at least partly a function of the diameter of the flexible tubing. Tubing that is more restrictive, i.e., having a smaller diameter, may have a reduced flow rate and a reduce pressure fluctuation. Sample fluid flow path 183 may have an inner diameter of approximately 0.5 μm to 10 μm The sample fluid flow system 180 provides this relatively variable, pressurized flow of sample fluid 54, via sample fluid flow path 183, to sample fluid pulse attenuator 186. The sample pulse attenuator 186 is designed to reduce and/or substantially eliminate these undesirable variations in the flow parameters associated with sample fluid flow stream 82 and provide a smoother sample fluid flow stream 85 having more consistent, less variable flow parameters.

Still referring to FIG. 9, the sample fluid pulse attenuator 186 may include an internal chamber having a constant volume. In a preferred embodiment, the sample fluid pulse attenuator 186 may be provided as a single, undivided volume. According to some embodiments, the volume of the sample pulse attenuator 186 may range from approximately 0.5 mL to approximately 10 mL. During operation, the sample pulse attenuator 186 is partially filled with an amount of sample fluid 54, which covers the sample fluid flow inlet and outlet. The remainder of the volume of the sample pulse attenuator 186 is filled with a compressible gas 36, such as air. According to this embodiment, the sample pulse attenuator 186 is a passive pulse attenuator, i.e., there is no secondary control system that monitors the pressure within the sample pulse attenuator 186 or that controls the flow rate of the sample fluid as a function of the pressure within the attenuator 186. Sample fluid flow path 185 may be configured to provide an appropriate resistance to the flow from the sample pulse attenuator 186 to the nozzle assembly 50. Fluid resistance is a function of both the cross-section of the flow path and the length of the flow path. In a preferred embodiment, sample fluid flow path has a length of 17.8 cm (7.0 inches) and an inner diameter of 12.7 μm (0.0005 inches). Other flow path resistances may be provided as suitable.

In general, the sample fluid flow generator 184 may be sized to provide up to approximately 20 μL/min of sample fluid 54. In preferred embodiments, for example for use with a droplet sorter, a sample fluid flow generator 184 may be configured to provide a flow rate of up to approximately 50 μL/min. As non-limiting examples, a peristaltic pump 184*a* may be configured to provide a flow rate of between approximately 5 μL/min to approximately 30 μL/min, between approximately 5 μL/min to approximately 50 μL/min, or even between approximately 20 μL/min to approximately 100 μL/min.

Similar to the embodiments described above with respect to FIG. 2, one or more sample fluid valves SV1, SV2, etc. may be provided in the sample fluid flow system 180. The sample fluid handling system 180 may include other valves, such as a pressure release safety valve, other filters and/or other sensors (not shown).

In accordance with certain embodiments, the regulated sample fluid flow stream 85 of the sample fluid 54 may join the working fluid flow stream 34, for example, a sheath fluid, in the fluid flow instrument 10 to form an entrained stream.

Figure 10:
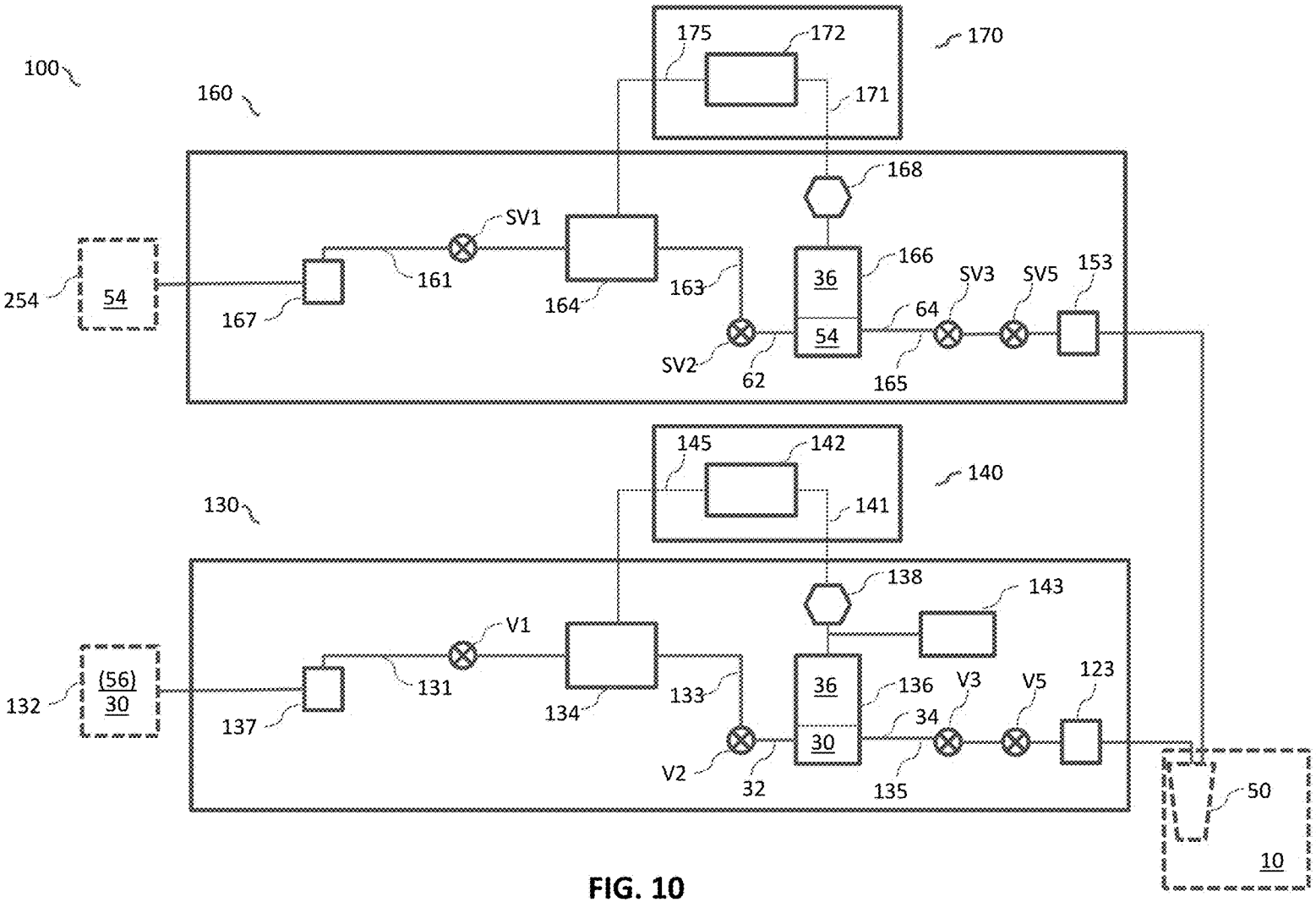
FIG. 10 illustrates a block diagram of an embodiment of a fluid handling system including both a working fluid handling system and a sample fluid handling system in accordance with certain aspects of this disclosure.

According to other aspects and referring now to FIG. 10, fluid handling system 100 may include a sample fluid flow system 160 in addition to and similar to the working fluid flow system 130 that delivers working fluid 30 (such as sheath fluid 56). Sample fluid flow system 160 may include a sample fluid flow generator 164 and a sample pulse attenuator 166. Further, the sample fluid flow system 160 may include a first sample fluid flow path 161 delivering fluid to the sample fluid flow generator 164, a second sample fluid flow path 163 receiving fluid from the sample fluid flow generator 164 and delivering fluid to the sample pulse attenuator 166, and a third sample fluid flow path 165 receiving fluid from the sample pulse attenuator 166 and delivering fluid to the fluid flow instrument 10. The components of the sample fluid flow system 160 are in fluid communication with each other.

The sample fluid flow system 160 may be configured to be coupled to, and placed in fluid communication with, a sample fluid supply 254. Specifically, the sample fluid flow generator 164 may be configured to be coupled to, and placed in fluid communication with, the sample fluid supply 254. A sample fluid 54 may be contained within the sample fluid supply 254. In general, the sample fluid supply 254 may be of any configuration capable of containing an amount of sample fluid 54.

The fluid handling system 100 may be configured to deliver a relatively stable stream of sample fluid 54 to the fluid flow instrument 10. The sample fluid flow generator 164 pulls sample fluid 54 from the sample fluid supply 254, via fluid flow path 161, and generates a pressurized sample fluid flow stream 62. The pressurized sample fluid flow stream 62 may have one or more flow parameters or characteristics that are relatively variable, and typically, not sufficiently stable to use as an input to flow-sensitive fluid flow instruments. The sample fluid flow system 160 provides this relatively variable, pressurized flow of sample fluid 54, via sample fluid flow path 163, to sample fluid pulse attenuator 166. The sample pulse attenuator 166 is designed to reduce and/or substantially eliminate these undesirable variations in the flow parameters associated with sample fluid flow stream 62 and provide a smoother sample fluid flow stream 64 having more consistent, less variable flow parameters. In other words, the sample fluid 54 may enter the pulse attenuator 166 as a relatively variable sample fluid flow stream 62, via fluid flow path 163, and exit the sample pulse attenuator 166 as a relatively stable sample fluid flow stream 64. Thus, a substantially invariant, regulated or controlled sample fluid flow stream 64 exits from sample fluid pulse attenuator 166 and is provided to fluid flow instrument 10, via sample fluid flow path 165. The regulated or controlled sample fluid flow stream 64 output from the fluid handling system 100 is suitable for input into fluid flow instruments 10 that are operationally sensitive to input fluid parameters and/or variations in the input fluid parameters.

Similar to the embodiments described above with respect to FIG. 2, a first sample fluid valve SV1 may be provided between the sample fluid supply 254 and the sample fluid flow generator 164. A second sample fluid valve SV2 may be provided between the sample fluid flow generator 164 and the sample fluid pulse attenuator 166. A third sample fluid valve SV3 may be provided between the sample fluid pulse attenuator 166 and the fluid flow instrument 10 or sort head 50. Optionally, a filter 167 may be positioned downstream of the sample fluid supply 254 and upstream of the sample fluid flow generator 164.

In certain embodiments, the sample fluid handling system 160 may also include a pressure release safety valve SV5 downstream of the pulse attenuator 166 and upstream of the sort head 50. The pressure release safety valve SV5 may be configured to be in communication with the sample control system 170. Alternatively, the pressure release safety valve SV5 may also be configured to be independent from the sample control system 170. The independently configured pressure release safety valve SV5 may be configured to release pressure if the control system 170 errs, to avoid over pressurizing the sample fluid handling system 130.

In certain embodiments, the sample fluid handling system 160 may also include a filter 153 downstream of the pulse attenuator 166 and upstream of the sort head 50.

Still referring to FIG. 10, the sample flow system 160 of the fluid handling system 100 may include a sample pulse attenuator 166. The sample pulse attenuator 166 receives a pressurized sample fluid flow stream 62 from the sample fluid flow generator 164. Typically, the pressurized sample fluid flow stream 62 received by the sample pulse attenuator 166 is pulsed and not sufficiently stable for delivery to the fluid flow instrument 10. Thus, the sample pulse attenuator 166 is controlled to adjust one or more parameters or characteristics of the sample fluid flow stream 62 in order to provide a relatively stable sample fluid flow stream 64 to the fluid flow instrument 10.

Similar to the working fluid pulse attenuator 136, the sample fluid pulse attenuator 166 may include an internal chamber having a constant volume. According to some embodiments, the volume of the sample pulse attenuator 166 may range from approximately 0.5 mL to approximately 10 mL. During operation, the sample pulse attenuator 166 is partially filled with an amount of sample fluid 54. The amount of sample fluid 54 within the sample pulse attenuator 166 is generally sufficient to cover the sample fluid flow inlets and outlets. The remainder of the volume of the sample pulse attenuator 166 is filled with a compressible gas 36. In preferred embodiments, the compressible gas is air. In preferred embodiments, there is no membrane or other element (deformable or non-deformable) separating the sample fluid 54 from the compressible gas 36. The sample fluid pulse attenuator 166 may be provided as a single, undivided volume. Optionally, in other embodiments, the sample fluid pulse attenuator 166 may have a membrane or other flexible barrier separating the sample fluid 54 from the compressible gas 36. This membrane may inhibit or block the sample fluid 54 from interacting with the gas 30.

Still referring to both FIG. 10, the sample pulse attenuator 166 may further include one or more fluid parameter sensor(s) 168 for directly or indirectly sense a value and/or variation of one or more flow parameters of the compressible gas 36 and/or the sample fluid 54 within the sample pulse attenuator 166. The fluid parameter sensor 168 may generate a fluid parameter signal 171 which varies based upon directly or indirectly sensed values and/or variations in the compressible gas 36 and/or the sample fluid 54 within the sample pulse attenuator 166. According to one embodiment, the fluid parameter sensor 168 may be a pressure transducer that generates a sample fluid parameter signal 171. The pressure transducer measures or senses the pressure of the air within the sample pulse attenuator 166. The sample pulse attenuator 166 may regulate or control one or more fluid flow parameters of the sample fluid 54 such that the sample fluid flow stream 62 entering the sample pulse attenuator 166 has different fluid flow parameters from the sample fluid flow stream 64 exiting the pulse attenuator 166. According to certain aspects, the sample pulse attenuator 166, in conjunction with a control system 170, may also adjust one or more fluid flow parameters of the sample fluid 54 by adjusting one or more parameters of the sample fluid flow generator 164.

Similar to control system 140, sample control system 170 may include a sample fluid controller 172 that runs a control application. The sample fluid controller 172 is in communication with the sample pulse attenuator 166 and configured to receive signals 171 from the sample sensor 168 associated with the sample pulse attenuator 166.

The sample fluid controller 172 may be in communication with the sample fluid flow generator 164 to regulate or control a flow parameter of the sample fluid flow stream 62 flowing from the sample fluid flow generator 164. For example, the sample fluid controller 172 may operate to control the flow rate of the sample fluid flow stream 62 flowing from the sample fluid flow generator 164. In general, the sample fluid controller 172 may operate to adjust the pressure, volume, rate, or other sample fluid characteristic of the sample fluid flow stream 62. For example, the sample fluid controller 172 may operate to intermittently or continuously supply sample fluid 54 to the sample pulse attenuator 166. As described above, the sample fluid flow generator 164 may be a pump. As a non-limiting example, the sample fluid controller 172 may control the speed of the pump's motor.

In preferred embodiments, sample fluid controller 172 may include a proportional-integral-derivative (PID) controller. The PID controller may be programmed to receive signals from the sample pulse attenuator 166 and send signals to the sample fluid flow generator 164. Further, the sample fluid controller 172 may be programmed to send and/or receive signals continuously from any of these components.

Thus, the sample fluid parameter sensor 168 may send a signal 171 to the sample control system 170 that reflects a variation in a fluid parameter of the gas and/or the sample fluid 54 within the sample pulse attenuator 166. The sample control system 170 may control one or more fluid parameters of the sample fluid flow stream 62 to regulate or control the fluid parameters of the sample fluid flow 64 exiting the sample pulse attenuator 166 and being provided to the fluid flow instrument 10.

Thus, according to exemplary embodiments, the sample control system 170 may operate to maintain the compressible gas (e.g., air) within the sample pulse attenuator 166 at a constant pressure or substantially constant ($P_A$).

Alternatively, pulses within a sample fluid flow stream may be ameliorated via use of a dual rotor peristaltic pump, velocity modulation of the rotor speed of the pump, one or more passive pulse dampener vessels, syringe pump delivery, and/or one or more actively pressurized (e.g., via use of an air compressor) air-over-fluid systems. Because the amount of sample fluid 54 is typically quite small, these solutions may be miniaturized. Further, certain of these systems may incorporate valves, flush sequences and/or other safeguards to prevent carryover (between samples).

In accordance with certain embodiments, the regulated sample fluid flow stream 64 of the sample fluid 54 may join the working fluid flow stream 34, for example, a sheath fluid, in the fluid flow instrument 10 to form an entrained stream.

Variations in the specific fluid flow paths, including additional valving, if desired, would be apparent to persons of ordinary skill in the art, given the benefit of this disclosure. For example, as described above, the working fluid flow generator 134 may be a peristaltic pump 134 having a dual rotor configuration. Thus, it would be apparent, given the benefit of the present disclosure, that fluid flow path 131 may be split into two parallel paths (for example, via a T-junction) upstream of the working fluid flow generator 134 and then combined back into a single fluid flow path 133 (for example, via a second T-junction) downstream of the working fluid flow generator 134. As another example, if desired, fluid flow path 135 may be split into one or more parallel flow paths upstream of sort head 50 so that working fluid 30 may enter sort head 50 via multiple inlets.

As another variation, a pressure gauge (not shown) may be positioned downstream of the working fluid flow generator 134 to provide an operator with a real-time readout of the working fluid pressure. As an option, the pressure handling system 100 may include a vacuum system (not shown) configured for connection, for example, to a waste path.

Referring back to FIG. 2, and according to even other aspects, the control system 140 may be used to monitor the fluid handling system for clogs or other operational anomalies. Thus, according to certain embodiments, a fluid handling system 100, as described above, may further include an operation sensor 139 coupled to the working fluid flow generator 134 and configured to monitor the operation of the generator 134. The operation sensor 139 may be configured to sense variations in operational characteristics (temperature, motor speed/rpm, rotor speed/rpm, power draw, vibrations, acoustics, etc.) of the working fluid flow generator 134. The operation sensor 139 may be configured to transmit a signal 149 to the control system 140 on a continuous or quasi-continuous basis.

During operation of the fluid handling system 100, the fluid variation sensor 138 may sense variations in a working fluid characteristic (pressure, flow in, flow out, temperature, volume, height, etc.) within the pulse attenuator 136 and sends signals 141 corresponding to these variations to fluid controller 142. In turn, the fluid controller 142 may send signals 145 to the working fluid flow generator 134. The operation of working fluid flow generator 134 may be adjusted (e.g., the motor speed may be increased, decreased, stopped and/or started) so as to regulate or control the fluid characteristic of the working fluid 30 being provided to the fluid flow instrument 10. During a steady-state condition, the signal 141 sent to the control system 140 from the fluid variation sensor 138 may settle into a substantially regular, relatively narrow-band fluctuation around a nominal value. Similarly, during a steady-state condition, the signal 145 sent to the working fluid flow generator 134 from the fluid controller 142 may settle into a substantially regular, relatively narrow-band fluctuation around a nominal value. A steady-state or stable condition may be defined as an operating state wherein the variation in the signal 141 and/or the signal 145 is less than a predetermined level for a predetermined time. For example, a steady-state condition may be defined as less than a 5 percent fluctuation of the signal 141 over a 10 second period. As another example, a steady-state condition may be defined as less than a 3 percent fluctuation of the signal 141 from a nominal or set-point value over the span of 10 revolutions of a peristaltic pump's rotor.

Close-loop control algorithms, for example as implemented by a PID controller, may continue to monitor the incoming signal 141 and adjust the control signal 145 at all times, including when the system is operating within a given steady-state condition, i.e., within any given band from the nominal value.

Under such steady-state conditions, the control system 140 may only need to make relatively minor adjustments to the operation of the working fluid flow generator 134. Consequently, during a steady-state operating condition of the pulse attenuator 136 (as may be determined by assessing the signal 141 and/or the signal 145), should the operation sensor 139 sense or register a step change, quasi-step change, or other unexpectedly large variation or change in the operational characteristics of the working fluid flow generator 134, this may indicate an anomaly in the operation of the fluid handling system 100. For example, should the signal 141 from the fluid parameter sensor 138 be fluctuating by less than 5 percent, but suddenly the operation sensor 139 signal 149 increases or decreases by more than 20 percent, an anomaly in the operation of the fluid handling system 100 may be present.

In certain embodiments, the control system 140 may be configured to compare a change in the signal 141 received from the fluid variation sensor 138 to a change in the signal 149 received from the working fluid flow generator operation sensor 139. In other embodiments, the control system 140 may be configured to compare a change in the signal 145 sent to working fluid flow generator 134 to a change in the signal 149 received from the working fluid flow generator operation sensor 139. The control system 140 may be configured to send an alarm or an alert signal if a predetermined variation or change in an operational characteristic of a component or system of the fluid handling system 100 is sensed during a period of steady-state or stable operation of the system 100. Additionally and/or alternatively, the control system 140 may be configured to shut down operation of the fluid handling system 100 if a predetermined variation or change in an operational characteristic of a component or system of the fluid handling system 100 is sensed during a period of steady-state or stable operation of the system 100. The predetermined change in the operation characteristic that triggers an alert, an alarm, or a shut-down need not be the same.

According to certain aspects, a fluid handling system 100 may supply working fluid 30 to a plurality of fluid flow instruments 10 operating at a similar pressure. For example, a working fluid flow stream 34 from a single pulse attenuator 136 may be supplied to a plurality of fluid flow instruments 10. Additionally and/or alternatively, a fluid handling system 100 may be provided with a plurality of pulse attenuators 136 and each pulse attenuator 136 may supply a regulated working fluid flow stream 34 to one or more fluid flow instruments 10. The working fluid 30 may be a sheath fluid, a sample fluid, a reagent fluid, etc. The working fluid 30 may be a shared fluid supply.

While the present disclosure has described specific examples including presently preferred modes of carrying out the disclosed systems and methods, those skilled in the art will appreciate that there are numerous variations and permutations of the above described systems and methods. Thus, the spirit and scope of the invention should be construed broadly as set forth in the appended claims.

The invention claimed is:

1. A fluid handling system for a particle processing instrument, the fluid handling system comprising:

a peristaltic pump having a first rotor with a plurality of first shoes for compressing a first working fluid flow tube and a second rotor with a plurality of second shoes for compressing a second working fluid flow tube;

a pulse attenuator;

a pressure transducer; and a pump controller, wherein the pump is configured to supply a pulsed flow of working fluid having a first pulse characteristic to the pulse attenuator;

wherein the pulse attenuator has a constant volume, one or more working fluid inlets, one or more working fluid outlets, and a pressure sensor port, the pulse attenuator being in fluid communication with the pump to receive the pulsed flow of working fluid via the one or more working fluid inlets, the pulse attenuator configured to supply an outlet flow of working fluid via the one or more working fluid outlets, the outlet flow having a second pulse characteristic different from the first pulse characteristic;

wherein the pressure transducer is in fluid communication with the pressure sensor port and in control communication with the pump controller;

wherein the pump controller is in control communication with the pump and is configured to maintain a substantially constant nominal pressure within the pulse attenuator by controlling the pump; and wherein at least some of the first shoes are circumferentially staggered with respect to at least some of the second shoes such that a timing of a pulsed flow of working fluid from the first working fluid flow tube is offset from a timing of a pulsed flow of working fluid from the second working fluid flow tube.

2. The fluid handling system of claim 1, wherein the pulse attenuator is a substantially rigid container.

3. The fluid handling system of claim 1, wherein the pulse attenuator is configured as a single, undivided volume.

4. The fluid handling system of claim 1, wherein the pulse attenuator does not include an inlet other than the one or more working fluid inlets.

5. The fluid handling system of claim 1, wherein, during a particle processing operation, the one or more working fluid inlets and the one or more working fluid outlets are in continuous working fluid communication with one another.

6. The fluid handling system of claim 1, wherein the one or more working fluid inlets and the one or more working fluid outlets are located in the lower quartile of the height of the pulse attenuator.

7. The fluid handling system of claim 1, wherein the fluid handling system is not in fluid communication with a source of pressurized gas.

8. The fluid handling system of claim 1, further comprising a valve downstream of the one or more working fluid outlets.

9. The fluid handling system of claim 1, wherein the peristaltic pump is configured to supply a pressure of at least 20 psi.

10. The fluid handling system of claim 1, wherein the peristaltic pump is configured to pressurize the pulse attenuator to a nominal pressure of at least 20 psi.

11. The fluid handling system of claim 1, wherein the first rotor and the second rotor are mounted on a common drive shaft.

12. The fluid handling system of claim 1, wherein the first rotor and the second rotor operate at a relative phase to one another.

13. The fluid handling system of claim 1, wherein the pump controller is configured to maintain the pressure within the pulse attenuator to within 0.002 psi of a nominal pressure.

14. The fluid handling system of claim 1, wherein the pump controller is configured to maintain the pressure at the output from the pulse attenuator to within 0.005 percent of a nominal pressure.

15. The fluid handling system of claim 1, wherein the pump controller controls the speed of the pump motor.

16. The fluid handling system of claim 1, wherein the pulse attenuator includes a flexible barrier between the working fluid and a compressible gas.

17. The fluid handling system of claim 1, wherein the ratio of the pressure pulse fluctuations of the outlet flow of working fluid entering the pulse attenuator to the pressure pulse fluctuations of the pulsed flow of working fluid exiting the pulse attenuator ranges from approximately 50:1 to approximately 200:1.

18. The fluid handling system of claim 1, wherein the ratio of the pressure pulse fluctuations of the outlet flow of working fluid entering the pulse attenuator to the pressure pulse fluctuations of the pulsed flow of working fluid exiting the pulse attenuator is greater than or equal to approximately 100:1.

19. The fluid handling system of claim 1, wherein the working fluid is a sheath fluid.

20. The fluid handling system of claim 1, wherein the working fluid is a sample fluid.

* * * * *